US005373226A

United States Patent [19]

Kimura

[11] Patent Number: 5,373,226

[45] Date of Patent: Dec. 13, 1994

[54] CONSTANT VOLTAGE CIRCUIT FORMED OF FETS AND REFERENCE VOLTAGE GENERATING CIRCUIT TO BE USED THEREFOR

[75] Inventor: Katsuji Kimura, Tokyo, Japan

[73] Assignee: NEC Corporation, Tokyo, Japan

[21] Appl. No.: 974,709

[22] Filed: Nov. 12, 1992

[30] Foreign Application Priority Data

| | | | |
|---|---|---|---|
| Nov. 15, 1991 | [JP] | Japan | 3-327062 |
| Jan. 9, 1992 | [JP] | Japan | 4-020481 |
| Jan. 9, 1992 | [JP] | Japan | 4-020482 |
| Jan. 29, 1992 | [JP] | Japan | 4-038519 |

[51] Int. Cl.[5] ..... G05F 3/26

[52] U.S. Cl. ..... 323/313; 323/316; 327/530; 327/541; 327/513

[58] Field of Search ..... 323/312, 313, 314, 315, 323/316, 907; 307/296.1, 296.5, 296.6, 296.7, 296.8

[56] References Cited

U.S. PATENT DOCUMENTS

| | | | |
|---|---|---|---|
| 4,954,769 | 9/1990 | Kalthoff | 323/313 |
| 5,126,653 | 6/1992 | Ganesan et al. | 323/313 |
| 5,206,581 | 4/1993 | Yoshida | 323/313 |
| 5,220,273 | 6/1993 | Mao | 323/313 |
| 5,229,711 | 7/1993 | Inoue | 323/313 |

*Primary Examiner*—Steven L. Stephan
*Assistant Examiner*—Adolf Berhane
*Attorney, Agent, or Firm*—Burns, Doane, Swecker & Mathis

[57] ABSTRACT

A constant voltage circuit formed of MOS transistors is provided, which comprises a reference voltage generator and an error amplifier performing the temperature compensation of a reference voltage outputted from the reference voltage generator and outputting a constant voltage. The reference voltage generator comprises first, second and third MOS transistors each driven by a constant current source, and outputs the reference voltage to the connecting end with the error amplifier. The error amplifier includes a differential pair of fourth and fifth MOS transistors whose capacity ratio is 1:K1, and an active load composed of sixth and seventh transistors whose capacity ratio is 1:K2. One of input pair of the differential pair is applied with the reference voltage and the other thereof is applied with a voltage obtained by dividing the constant voltage. The output voltage of the differential pair is outputted to the outside as the constant voltage from an output circuit including resistors for dividing the constant voltage.

36 Claims, 12 Drawing Sheets

CONSTANT VOLTAGE CIRCUIT FORMED OF FETS AND REFERENCE VOLTAGE GENERATING CIRCUIT TO BE USED THEREFOR

BACKGROUND OF THE INVENTION

1. Field of the Invention

This invention relates to a constant voltage circuit formed of field effect transistors (FETs) such as metal-oxide-semiconductor (MOS) transistors and a reference voltage generating circuit to be used therefor.

2. Description of the Prior Art

As known previously, a conventional constant voltage circuit is of a bandgap reference circuit formed of bipolar transistors in general, and a practically usable constant voltage circuit formed entirely of MOS transistors is not known. Under such a circumstance, a constant voltage circuit capable of being realized on an MOS integrated circuit has been demanded to be developed in order to utilize various advantages of the MOS transistor.

The MOS transistor is large in production variation and has a non-linear temperature characteristic different from the bipolar transistor whose temperature variation is linear. As a result, in order to make a constant voltage circuit requiring good temperature characteristic of MOS transistors, it is an important problem how the temperature characteristic of such MOS transistors is controlled.

SUMMARY OF THE INVENTION

Thus, an object of this invention is to provide a constant voltage circuit capable of being realized on an MOS integrated circuit.

Another object of this invention is to provide a reference voltage generating circuit to be used for a constant voltage circuit, which is capable of being realized on an MOS integrated circuit.

In a first aspect of this invention, a constant voltage circuit is provided, which comprises a reference voltage generator and an error amplifier for correcting the temperature characteristic of the reference voltage outputted from the reference voltage generator.

The reference voltage generator comprises a constant current source, a first field effect transistor which has the source connected to the earth, the gate connected through a first resister to the output side of the constant current source and the drain connected to the first resistor, a second field effect transistor which has the source connected to the earth, the gate connected to the drain of the first transistor and the drain connected through a second resistor to the output side of the constant current source, a third field effect transistor which has the source connected to the earth, the gate connected to the drain of the second transistor and the drain connected to the output side of the constant current source.

The error amplifier comprises a differential circuit, an active lead for the differential circuit, and an output circuit.

The differential circuit comprises a differential pair of fourth and fifth field effect transistors whose capacity ratio is made as to 1:K1. One of the input pair terminals of the differential pair is applied with the reference voltage generated at the connecting point of the constant current source and the first and second resisters, and the another thereof is applied with a voltage obtained by dividing a constant output voltage outputted from the error amplifier.

The active lead is provided between the differential circuit and a power source, and comprises a sixth and seventh field effect transistors whose capacity ratio is made as to 1:K2.

The output circuit batches the output of the differential circuit and outputting it to the outside as a constant voltage, and divides the constant voltage by a third and fourth resistors to feed to the one of the input pair terminals of the differential circuit.

In a preferred embodiment of the first aspect, the first transistor of the reference voltage generator has the drain connected directly or through a fifth resistor to the first resistor. And the second transistor thereof has the source connected directly or through a sixth resistor to the earth.

In another preferred embodiment of the first aspect, the output circuit of the error amplifier comprises a eighth field effect transistor in which the output from the differential circuit is inputted through the active load, and the third and fourth resistors for dividing the constant voltage are connected between the drain of the eighth transistor and the earth.

In still another preferred embodiment of the first aspect, the output circuit comprises a eighth field effect transistor in which the output from the differential circuit is inputted through the active load, and a ninth field effect transistor in which the output from the eighth transistor is inputted, and the third and fourth resistors for dividing the constant voltage are connected between the drain of the ninth transistor and the earth.

In the constant voltage circuit of this aspect, the temperature characteristic of the reference voltage outputted from the reference voltage generator is corrected by the error amplifier to obtain a constant voltage. And the correction of temperature characteristic in the error amplifier can be controlled by setting the values of K1 and K2 showing the respective capacity ratios of the transistors.

As a result, by setting the values of K1 and K2 according to the temperature characteristic of the respective transistors, a suitable constant voltage characteristic to be realized on an MOS integrated circuit can be obtained.

In a second aspect of this invention, a constant voltage circuit is provided, which comprises a constant current circuit, a reference voltage generator driven by the output current from the constant current circuit and generating a reference voltage and an offset generator correcting temperature characteristic of the reference voltage to output a constant voltage.

The reference voltage generator comprises a first field effect transistor which has the source connected to the earth, the gate connected through a first resister to the output side of the constant current circuit and the drain connected to the first resister, a second field effect transistor which has the source connected to the earth, the gate connected to the drain of the first transistor and the drain connected through a second resistor to the output side of the constant current circuit, a third field effect transistor which has the source connected to the earth, the gate connected to the drain of the second transistor and the drain connected to the output side of the constant current circuit.

The constant current circuit, comprises a fourth field effect transistor which has the source connected to the earth, the gate and the drain are connected each other, a fifth field effect transistor which has the source connected to the earth and the gate connected to the drain of the fourth transistor, a current mirror circuit which drives the fourth and fifth transistors at the current ratio of K1:1 and supplies a driving current to the reference voltage generator.

The offset generator comprises a differential circuit, an active lead of the differential circuit and an output circuit.

The differential circuit comprises a differential pair composed of two transistors whose capacity ratio is different from each other, and one of the input pair terminals of the differential pair is applied with the reference voltage outputted from the reference voltage generator and another thereof is applied with the output voltage from the offset generator.

The active lead comprises a differential pair composed of two transistors whose capacity ratio is different from each other.

In a preferred embodiment of the second aspect, the first transistor of the reference voltage generator has the drain connected directly or through a third resistor to the first resistor.

In another preferred embodiment, of the second aspect, the second transistor of the reference voltage generator has the source connected directly or through a fourth resistor to the earth.

In still another preferred embodiment of the second aspect, the fifth transistor of the constant current circuit has the source connected directly or through a fifth resistor to the earth.

In the constant voltage circuit of the second aspect, the reference voltage generator and offset generator are driven by the constant current circuit having temperature characteristic, and the temperature characteristic of the reference voltage outputted from the reference voltage generator is corrected by the offset generator to obtain a constant voltage. And the correction of temperature characteristic in the offset generator can be arbitarily set to any positive or negative value or zero (0).

As a result, a suitable constant voltage characteristic to be realized on an MOS integrated circuit can be obtained.

In a third aspect of this invention, a reference voltage generating circuit to be used for a constant voltage circuit is provided, which comprises a constant current circuit and a constant voltage generator which is driven by the constant current circuit and outputted to the connecting end to the constant current circuit.

The constant voltage generator comprises a first field effect transistor which has the source connected to the earth, the gate connected through a first resistor to the output side of the constant current circuit and the drain connected to the first resistor, a second field effect transistor which has the source connected to the earth, the gate connected to the drain of the first transistor and the drain connected through a second resistor to the output side of the constant current circuit 22, a third field effect transistor which has the source connected to the earth, the gate connected to the drain of the second transistor and the drain connected to the output side of the constant current circuit.

The constant current circuit comprises a fourth field effect transistor which has the source connected to the earth and the gate and drain connected to each other, a fifth field effect transistor which has the source connected to the earth and the gate connected to the drain of the fourth transistor, a sixth and a seventh field effect transistor, and a current mirror circuit which drives the fourth and fifth transistors at the current ratio of K:1 and supplies a driving current to the constant voltage generator.

In a preferred embodiment of the third aspect, the first transistor of the constant voltage generator has the drain connected directly or through a third resistor to the first resistor.

In another preferred embodiment of the third aspect, the second transistor of the constant voltage generator has the source connected directly or through a fourth resistor to the earth.

In another preferred embodiment of the third aspect, the fourth transistor of the constant current circuit has the gate and drain connected to directly or through a fifth resistor each other.

In still another preferred embodiment of the third aspect, the fifth transistor of the constant current circuit has the source connected directly or through a sixth resistor to the earth.

In the reference voltage generating circuit of the third aspect, the constant voltage generator and the constant current circuit for driving the generator can be respectively composed of MOS transistors, and the peaking characteristics of the both circuit can be set so as to cancel the temperature characteristic of the output voltage, so that the temperature characteristic of the reference voltage to be outputted can be made substantially zero. In addition, it can be realized on a CMOS integrated circuit.

In a fourth aspect of this invention, a reference voltage generating circuit to be used for a constant voltage circuit is provided, which comprises a first and second constant current circuits, a first and second field effect transistors and a first and second control circuits.

The first transistor has the source connected to the earth or to a power source, the gate connected through a first resistor to the first constant current circuit and the drain connected to the first resistor.

The second transistor has the source connected to the earth or the power source, the gate connected to the drain of the first transistor and the drain connected through a second resistor to the second constant current circuit.

The first control circuit controls the first and second current sources so that a first voltage generated at the connecting end to the first current source and the first resistor and a second voltage generated at the connecting end to the second current source and the second resistor may be equal to each other.

The second control circuit controls the second transistor so that the characteristic of the drain current of the second transistor and the characteristic of the second voltage do not effect contrariwise each other.

In a preferred embodiment of the fourth aspect, the first transistor has the drain connected directly or through a third resistor to the first resistor.

In another preferred embodiment of the fourth aspect, the second transistor has the source connected directly or through a fourth resistor to the earth or the power source.

In the reference voltage generating circuit according to the fourth aspect, the characteristic of the drain current of the second transistor and the characteristic of the second voltage are prevented from effecting contrariwise each other, and the first and second voltages are surely made equal to each other.

Is a result, the first or second voltage for providing the reference voltage as an output voltage of the reference voltage generator is formed of the sum of a voltage inversely proportional to the transconductance parameter and the threshold voltage, so that the temperature characteristic of the reference voltage can be arbitrarily set so as to be positive, negative or zero.

Consequently, the reference voltage generator of this aspect can be appropriately realized on a CMOS integrated circuit.

In the first to fourth aspects of this invention, "the capacity ratio" of the transistor pair means as follows:

If one of the two transistors of the transistor pair has a ratio A1 of the gate width W and gate length L, or (W/L)1 and another of the two transistors has a ratio A2 of the gate width W and gate length L, or (W/L)2, "the capacity ratio" is a ratio of A1 and A2, or a ratio of (W/L)1 and (W/L)2.

In the first to fourth aspects of this invention, MOS transistors preferably used as the field effect transistors.

DESCRIPTION OF THE PREFERRED EMBODIMENTS

Figure 1:
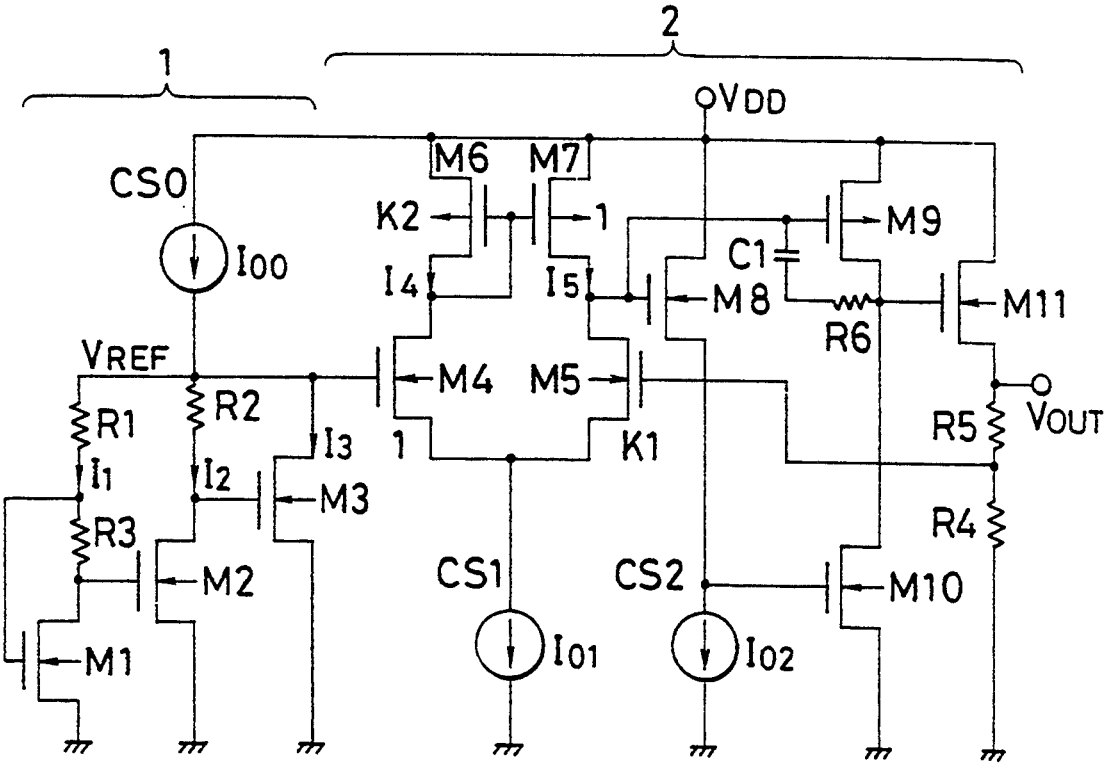
FIG. 1 is a circuit diagram of a constant voltage circuit according to a first embodiment of this invention.

Preferred embodiments of this invention will be described below while referring to the drawings attached.

[First Embodiment]

FIG. 1 shows a circuit diagram of a constant voltage according to a first embodiment of this invention, which comprises a reference voltage generator 1 and an error amplifier 2.

The reference voltage generator 1 basically comprises a constant current source CSO (constant current I00) provided on the side of a power source (supply voltage VDD) and three N-channel MOS transistors M1, M2 and M3. The MOS transistor M1 has the source connected directly to the earth, the gate connected through a resister R1 to the output side of the constant current source CSO and the drain connected through a resistor R3 to the resistor R1. This means that the drain thereof is connected to the output side of the constant current source CSO through the resistors R3 and R1 provided in series.

The transistor M2 has the source connected directly to the earth, the gate connected to the drain of the transistor M1 and the drain connected through a resistor R2 to the output side of the constant current source CSO.

The transistor M3 has the source connected directly to the earth, the gate connected to the drain of the transistor M2 and the drain connected directly to the output side of the constant current source CSO.

As known conventionally, the constant current source CSO may be controlled by a negative-feedback loop, however, in such case, the drain of the transistor M3 may be connected directly to the negative-feedback loop controlling the constant current source CSO.

Here, if drain currents of the transistors M1, M2 and M3 are expressed as I1, I2 and I3, respectively, the reference voltage generator 1 operates so as to satisfy the following relation as $$I00 - I3 = I1 + I2$$

and outputs a reference voltage VREF to the connecting point of the resistors R1 and R2. The operational principle of the reference voltage generator 1 will be explained below concretely.

If the gate-to-source voltages of the transistors M1, M2 and M3 are expressed as VGS1, VGS2 and VGS3, respectively, the reference voltage VREF can be obtained as $$VREF = VGS1 + R1.I1$$

and $$VGS1 - VGS2 = R2.I1$$

Hence, from these equations, the reference voltage VREF can be expressed as follows:

$$VREF = VGS1 + (R1/R2)\cdot(VGS1 - VGS2) \quad (1)$$

As a result, the temperature characteristic of the reference voltage VREF can be obtained by differentiating the equation (1) with respect to the temperature, as $$dVREF/dt = dVGS1/dT + (R1/R2)(dVGS1/dT - dVGS2/dT) \quad (2)$$

$$= \{1 + (R1/R2)\}(dVGS1/dT) - (R1/R2)(dVGS2/dT)$$

In the equation (2), if (R1/R2)>>1, it can approximated as follows:

$$dVREF/dT \approx (R1/R2)(dVGS1/dT - dVGS2/dT) \quad (3)$$

From the equation (3), it can be found that the value (dVREF/dT) showing the temperature characteristic of the reference voltage VREF will be made positive, negative or zero depending on the relationship between (dVGS1/dT) and (dVGS2/dT).

Next, explanations will be made on the error amplifier 2.

In the error amplifier 2 shown in FIG. 1, a differential pair composed of N-channel MOS transistors M4 and M5 and a constant current source CS1 (constant current I01) for driving the differential pair form a differential circuit, and P-channel MOS transistors M6 and M7 respectively disposed between the differential transistors pair M4 and M5 and the power source form an active load for the differential circuit. The ratio of the gate width W and gate length L, or (W/L), between the transistors M4 and M5 is made as to be (W/L)4:(W/L)5=1:K1. For the transistors M6 and M7, it is made as to be (W/L)6:(W/L)7=K2:1. The output of the differential pair is delivered to a level shift circuit and an output circuit shown later.

In the differential pair composed of the transistors M4 and M5, the gate of the transistor M4 is applied with the reference voltage VREF generated and outputted from the reference voltage generator 1 through the connecting point of the resistor R1 and R2 and the drain of the transistor M3, and the gate of the transistor M5 is applied with a voltage obtained by dividing an output voltage VOUT in an output circuit of an error amplifier 2 shown later.

An N-channel MOS transistor M8 and a constant current source CS2 (constant current I02) for driving the transistor M8 form a level shift circuit for level-shifting an output of the differential circuit. The output voltage of the differential circuit is applied to the gate of the transistor M8.

A P-channel MOS transistor M9, N-channel MOS transistors M10 and M11, a capacitor C1 and resistors R4, R5 and R6 form an output circuit for batching an output of the differential circuit and outputting it to the outside as a constant voltage VOUT having the desired characteristic. The output of the transistors M9 and M10 is fed to the gate of the transistor M11, and the constant voltage VOUT is outputted to the outside from one end of the resistor R5 disposed between the source of the transistor M11 and the earth.

A series circuit made of the resistor R4 and R5 disposed between the source of the transistor M11 and the earth forms a voltage divider for dividing the constant voltage VOUT to be outputted. The voltage obtained by the voltage divider is, as explained above, fed back to the gate of the transistor M5 of the differential circuit. The output voltage of the differential circuit is fed to the gate of the transistor M9. In this embodiment, the transistor M11 serves to act as a voltage pass element.

In the two transistors M4 and M5 forming the differential pair, the capacity ratio thereof is made as to be (W/L)4:(W/L)5=1:K1, and in the two transistors M6 and M7 forming the active load, it is made as to be (W/L)6:(W/L)7=K2:1. As a result, the input of the differential pair has an offset, This offset voltage VOS can be determined as follows:

First, in the differential circuit, transconductance parameter $\beta 1$ of the transistor M4 can be obtained as follows:

$$\beta 1 = \mu n\cdot COX\cdot(W/L)4\cdot(\tfrac{1}{2})$$

where (W/L)4=gate width (W)-to-length(L) ratio,

VT=the threshold voltage, $\mu n$=the effective electron mobility, and

Cox=the gate oxide film capacity per unit area.

Therefore, transconductance parameter of the transistor M5 becomes (K1·$\beta$1).

As a result, the drain current I4 of the transistor M4 and the drain current I5 of the transistor M5 can be shown as follows:

$$I4 = \beta 1(VGS4 - VT)^2 \quad (4)$$

$$I5 = K1\cdot\beta 1(VGS5 - VT)^2 \quad (5)$$

The sum of them can be expressed as follows:

$$I4 + I5 = I01 \quad (6)$$

Besides, the offset voltage VOS can be expressed as the difference of the respective gate-to-source voltages VGS4 and VGS5 of the transistors M4 and M5, or $$VOS = VGS4 - VGS5 \quad (7)$$

The active load made of the two transistors M6 and M7 forming an unbalanced pair operates so as to maintain a relation as $$I4 = K2\cdot I5$$

and from the equation (6), the drain currents I4 and I5 can be expressed as follows:

$$I4 = \{K2/(K2+1)\}\cdot I01 \quad (8)$$

$$I5 = \{1/(K2+1)\}\cdot I01 \quad (9)$$

Accordingly, by substituting the equations (8) and (9) in the equations (4) and (5), respectively, the offset voltage VOS can be expressed as follows:

$$VOS = (VGS4 - VT) - (VGS5 - VT) \quad (10)$$

$$= (I01/\beta 1)^{\frac{1}{2}}\cdot\{K2/(K2+1)\}^{\frac{1}{2}}\cdot\{1 - 1/(K1\cdot K2)^{\frac{1}{2}}\}$$

$$= (1/\mu n^{\frac{1}{2}})(2\cdot I01/COX)^{\frac{1}{2}}\cdot[1/\{(W/L)4\}^{\frac{1}{2}}]\times$$

$$\{K_2/(K_2+1)\}^{\frac{1}{2}}\cdot\{1 - 1/(K_1\cdot K_2)^{\frac{1}{2}}\}$$

The equation (10) shows that the offset voltage VOS is in inverse proportion to the square root of the electron mobility $\mu n$.

The mobility $\mu n$ has a temperature characteristic, and the ratio of the mobility $\mu n(T)$ at absolute temperature T and the mobility $\mu n(T0)$ at absolute temperature To can be related as follows:

$$\mu n(T0)/\mu n(T)=(T0/T)^{-3/2} \quad (11)$$

As a result, it can be found that the offset voltage VOS is approximately proportional to absolute temperature and can be expressed as follows:

$$VOS=(2\cdot I01/COX)^{\frac{1}{2}}\cdot[1/\{(W/L)4\}^{\frac{1}{2}}]\cdot\{K_2/(K_2+1)\} \times\{1-1/(K1\cdot K2)^{\frac{1}{2}}\}\cdot\{1/(\mu n(T0))^{\frac{1}{2}}\}\cdot(T/T0)^{\frac{1}{4}} \quad (12)$$

From the equation (12), it can be further found that the offset voltage VOS may become positive, negative or zero depending on whether K1 and K2 are larger or smaller than one (1). That is, if K1>1 and K2>1, VOS>0, if K1=K2=1, VOS=0, and if K1<1 and K2<1, VOS<0.

Beside, the outputted constant voltage VOUT and the reference voltage VREF are related as follows:

$$\{R4/(R4+R5)\}\cdot VOUT=VREF+VOS \quad (13)$$

$$\therefore VOUT=\{1+(R5/R4)\}\cdot(VREF+VOS) \quad (14)$$

Here, the temperature characteristic of the outputted constant voltage VOUT can be expressed as follows:

$$dVOUT/dT=\{1+(R5/R4)\}\cdot\{(dVREF/dT)+(dVOS/dT)\} \quad (15)$$

In this case, from the equation (3), the value (dVREF/dT) will become positive, negative or zero depending on the relationship of (dVGS1/dT) and (dVGS2/dT). In addition, from the equation (12), the value (dVOS/dT) will become positive, negative or zero depending on the values of K1 and K2. As a result, from the equation (15), it can be found that the value (dVOUT/dT) can be set to any of positive and negative values and zero.

As explained above, in the constant voltage circuit of this embodiment, the temperature characteristic of the reference voltage VREF outputted from the reference voltage generator 1 is corrected by the error amplifier 2 to obtain a constant voltage and the correction of temperature. characteristic in the error amplifier 2 can be appropriately controlled depending on whether the values of K1 and K2 showing respectively the ratio of the gate width-to-length ratios (W/L) the MOS transistor pair are equal to or larger or smaller than one (1).

As a result, by setting the values of K1 and K2 according to the temperature characteristic of the respective MOS transistors, a suitable constant voltage characteristic to be realized on an MOS integrated circuit can be obtained.

Here, if considered when (dVOUT/dT)=0, from the equation (15), (dVOS/dT) can be shown as $$dVOS/dT=-(dVREF/dT) \quad (16)$$

On the other hand, from the equation (12), (dVOS/dT) can be shown as $$dVOS/dT = (3/4)(1/T0)(2\cdot I01/COX)^{\frac{1}{2}}\cdot[1/\{(W/L)_1\}^{\frac{1}{2}}]\times \quad (17)$$

-continued $$\{K_2/(K_2+1)\}^{\frac{1}{2}}\cdot\{1-1/(K_1\cdot K_2)^{\frac{1}{2}}\}\times\{1/(\mu_n(T_0))^{\frac{1}{2}}\}(T/T_0)^{-\frac{1}{4}}$$

In the equation (17), absolute temperature is root-compressed two times, that is, it is raised to the ($\frac{1}{4}$)-th power, so that the value (dVOS/dT) can be approximated as $$dVOS/dT\simeq(\tfrac{3}{4})(1/T0)(2\cdot I01/COX)^{\frac{1}{2}}\cdot[1/\{(W/L)1\}^{\frac{1}{2}}]\cdot \times\{K_2/(K_2+1)\}^{\frac{1}{2}}\cdot\{1-1/(K_1\cdot K_2)^{\frac{1}{2}}\}\cdot\{1/(\mu n(T0))^{\frac{1}{2}}\} \quad (18)$$

From the equation (18), it can be found that by appropriately setting K1, K2, I01 and (W/L)4, the equation (16) can be established. Consequently, a constant voltage circuit in which the temperature characteristic of the constant voltage VOUT to be outputted is zero, that is, the output voltage is not changed depending on the temperature, can be obtained by having the equation (16) established.

The variation of the reference voltage VREF due to a change in source voltage VDD can be reduced by increasing transconductance parameter of the three transistors M1, M2 and M3 of the reference voltage generator 1. For this, the ratio of the gate width (W) and gate length (L), or (W/L) may be increased. This is based on the same principle as in the case of bipolar transistors.

[Second Embodiment]

Figure 2:
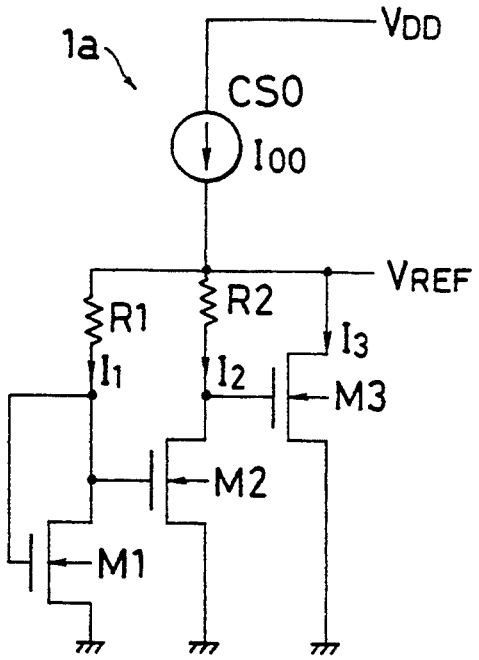
FIG. 2 is a partial circuit diagram of a constant voltage circuit according to a second embodiment of this invention.

FIG. 2 shows a reference voltage generator of a constant voltage circuit according to a second embodiment of this invention. In FIG. 2, a reference voltage generator 1*a* is similar in structure to the reference voltage generator 1 shown in FIG. 1 excepting that the resistor R3 is omitted in the generator 1 of FIG. 1 and the gate and drain of the MOS transistor M1 are connected directly. In this case, an internal resistance is provided between the drain and source of the transistor M1 is utilized.

Such circuit makes it possible to obtain the same effects as those of the first embodiment.

[Third Embodiment]

Figure 3:
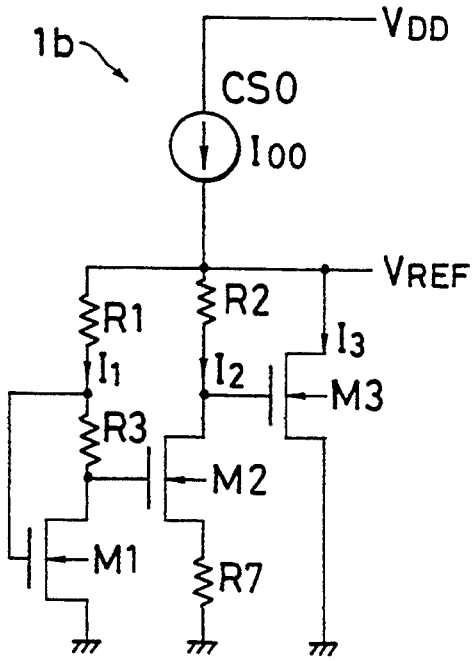
FIG. 3 is a partial circuit diagram of a constant voltage circuit according to a third embodiment of this invention.

FIG. 3 shows a reference voltage generator of a constant voltage circuit according to a third embodiment of this invention. In FIG. 3, a reference voltage generator 1*b* is similar in structure to the reference voltage generator 1 shown in FIG. 1 excepting that a resistor R7 is provided between the source of the MOS transistor M2 and the earth.

Such circuit also makes it possible to obtain the same effects as those of the first embodiment.

[Fourth Embodiment]

Figure 4:
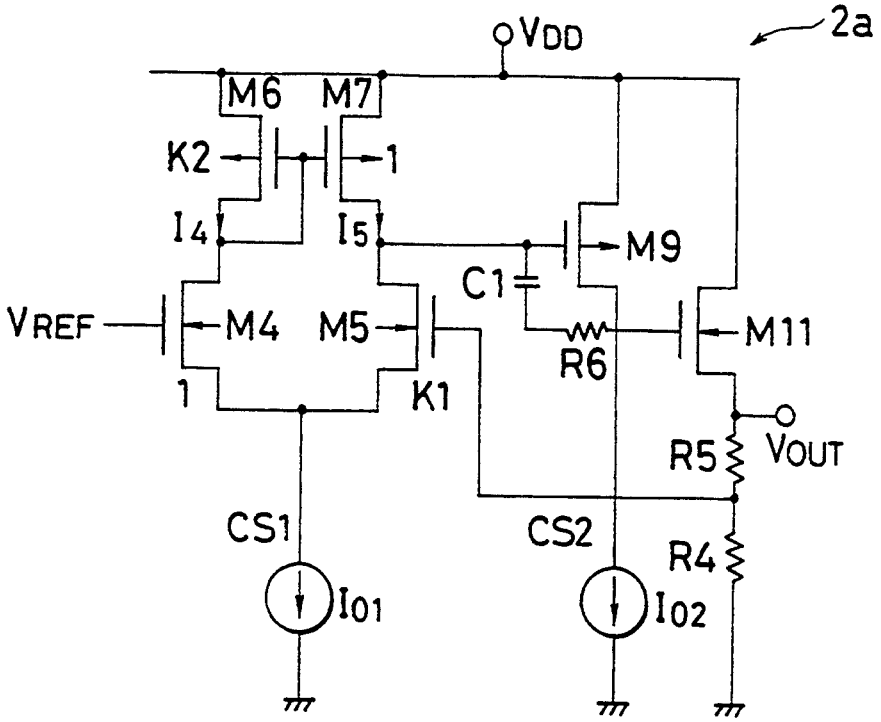
FIG. 4 is a partial circuit diagram of a constant voltage circuit according to a fourth embodiment of this invention.

FIG. 4 shows an error amplifier of a constant voltage circuit according to a fourth embodiment of this invention. In FIG. 4, an error amplifier 2*a* is similar in structure to the error amplifier 2 shown in FIG. 1 excepting that the MOS transistors M11 and M10 are omitted in the error amplifier 2 of FIG. 1. The error amplifier 2*a* does not have a level shift circuit.

Such circuit also makes it possible to obtain the same effects as those of the first embodiment.

[Fifth Embodiment]

Figure 5:
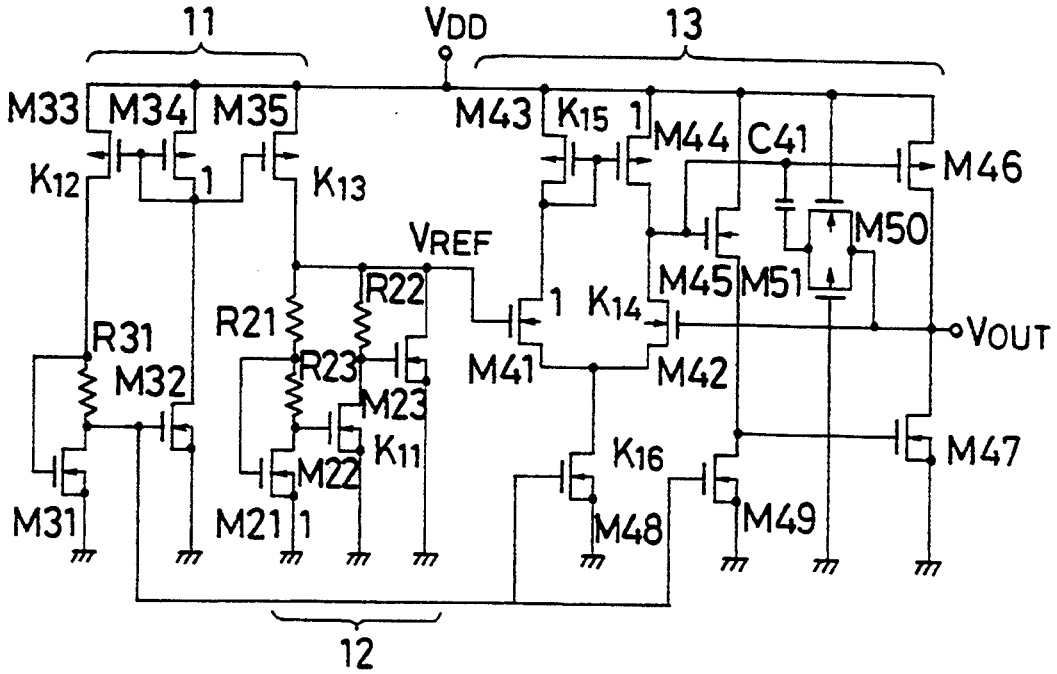
FIG. 5 is a circuit diagram of a constant voltage circuit according to a fifth embodiment of this invention.

FIG. 5 shows a constant voltage circuit according to a fifth embodiment of this invention, which comprises a constant current circuit 11, a reference voltage generator 12 and an offset generator 13.

The reference voltage generator 12 comprises mainly of three N-channel MOS transistors M21, M22 and M23. The MOS transistor M21 has the source connected directly to the earth, the gate connected through a resistor R21 to the output side of the constant current circuit 11, that is, to the source of a transistor M35, and the drain connected through a resistor R23 to the resistor R21. As a result, the drain of the transistor M21 is connected through the resisters R21 and R23 provided in series to the output side of the constant current circuit 11.

The MOS transistor M22 has the source connected directly to the earth, the gate connected to the drain of the transistor M21 and the drain connected through the resistor R22 to the output side of the constant current circuit 11, that is, to the source of the transistor M35.

The MOS transistor M23 has the source connected directly to the earth, the gate connected to the drain of the transistor M22 and the drain connected directly to the output side of the constant current circuit 11, that is, to the source of the transistor M35.

The transistors M21 and M22 form a peaking current mirror circuit and the capacity ratio of the both transistors is made as to be (W/L)21:(W/L)22=1:K11.

The constant current circuit 11 comprises mainly five MOS transistors M31, M32, M33, M34 and M35.

The N-channel MOS transistor M31 has the source connected directly to the earth, the gate connected through a resistor R31 to the drain and the drain connected to the drain of the P-channel MOS transistor M33. The N-channel MOS transistor M32 has the source connected directly to the earth, the gate connected to the drain of the transistor M31 and the drain connected to the drain of the P-channel MOS transistor M34.

The transistors M31 and M32 form a peaking current mirror circuit.

The MOS transistors M33 and M34 form a simple current mirror circuit for driving the transistors M31 and M32, the capacity ratio of which is made as to be (W/L)33:(W/L)34=1:K12. The transistors M31 and M32 are driven with the capacity ratio of 1:K12.

The MOS transistors M34 and M35 form a simple current mirror circuit for supplying a driving current to the voltage generator 12, the capacity ratio of which is made as to be (W/L)34:(W/L)35=1:K13.

The reference voltage generator 12 outputs a reference voltage VREF to the connecting point with the constant current circuit 11 and operates as shown below.

If the driving currents of the transistors M21 and M22, namely, the drain currents are expressed as I21 and I22 and the gate-to-source voltages thereof are expressed as VGS21 and VGS22, respectively, the following relations are obtained as:

$$VREF = VGS21 + R21 \cdot I21,$$

$$VGS21 - VGS22 = R23 \cdot I21$$

From these equations, the reference voltage VREF becomes as follows:

$$VREF = VGS21 + (R21/R23)(VGS21 - VGS22) \quad (19)$$

On the other hand, if the threshold voltage and transconductance parameter of the transistor M21 are expressed as VTH and $\beta$, respectively, the drain currents I21 and I22 can be expressed as follows:

$$I21 = \beta(VGS21 - VTH)^2 \quad (20)$$

$$I22 = K11 \cdot \beta(VGS22 - VTH)^2 \quad (21)$$

Accordingly, by substituting the equations (20) and (21) into the equation (19), the reference voltage VREF can be obtained as follows:

$$\begin{aligned} VREF &= (I21/\beta)^{\frac{1}{2}} + VTH + \\ &\quad (R21/R23) \cdot [(I21/\beta)^{\frac{1}{2}} - \{I22/(K11 \cdot \beta)^{\frac{1}{2}}\}] \\ &= (1/\beta^{\frac{1}{2}}) \times [I21^{\frac{1}{2}} \cdot \{1 + (R21/R23)\} - \\ &\quad (I22/K11)^{\frac{1}{2}} \cdot (R21/R23)\}] + VTH \end{aligned} \quad (22)$$

From the equation (22), it can be found that the drain currents I21 and I22 are both root-compressed and as a result, the variation width of the reference voltage VREF is compressed in response to the change of the drain currents I21 and I22.

On the other hand, if the constant current outputted by the constant current circuit 11 is expressed as I0, it is equal to the drain current of the transistor M35, so that the following equation can be established as $$I21 + I22 + I23 = I0 \quad (23)$$

As seen from the equation (23), the gate voltage of the transistor M23 increases with an increase in the reference voltage VREF and as a result, if the drain circuit I23 is increased thereby, the sum of the drain currents or (I21+I22) is decreased by that incremental fraction. This means that if the reference voltage VREF is varied, the negative feedback is acted on so as to cancel the variation thereof. As a result, the reference voltage VREF expressed by the equation (22) can take a substantially constant value to the change of the drain currents I21 and I22.

As explained above, the desired reference voltage can be obtained through the MOS transistors M21, M22 and M23.

Here, supposing that transconductance parameter $\beta$ of the transistors M21 is not so large and the resistor R23 also is not so large in resistance, it can be seen that the drain currents I21 and I22 are substantially proportional to each other. Namely, if the transconductance parameter $\beta$ of the transistor M21 and the resistance of the resistor R23 are set so as to have a mutual relation of the drain currents I21 and I22 without the peaking characteristic, the drain currents I21 and I22 are related as follows:

$$I22 = a \cdot I21 \quad (24)$$

where a is constant.

Then, by substituting the equation (24) into the equation (22), the reference voltage VREF can be expressed as follows:

$$VREF = (I21/\beta)^{\frac{1}{2}} \cdot [1 + (R21/R23) \cdot \{1 - (a/K11)^{\frac{1}{2}}\}] + VTH \quad (25)$$

Next, the operation of the constant current 11 will be explained below.

In the constant current circuit 11, if transconductance parameter of the transistors M31 is expressed as $\beta$, the drain current I31 of the transistor M31 is expressed as $$I31 = \beta(VGS31 - VTH)^2 \quad (26)$$

and the drain current I32 of the transistor M32 can be obtained as $$I32=\beta(VGS32-VTH)^2 \quad (27)$$

The difference of the respective gate-to-source voltages VGS31 and VGS32 of the transistors M31 and M32 can be expressed as $$VGS31-VGS32=R31\cdot I31 \quad (28)$$

The transistors M13 and M14 form a current mirror circuit whose current ratio is K12:1, and the drain currents I31 and I32 can be related as $$I31=K12\cdot I32 \quad (29)$$

From the equations (26) to (29), the following equations can be obtained as:

$$I31\cdot R31=(I31/\beta)^{\frac{1}{2}}-\{I31/(K12\cdot\beta)\}^{\frac{1}{2}} \quad (30)$$

$$(I31)^{\frac{1}{2}}\cdot[\beta^{\frac{1}{2}}\cdot R31\cdot(I31)^{\frac{1}{2}}-\{1-(1/K12)^{\frac{1}{2}}\}]=0 \quad (31)$$

In the equation (31), I31>0, so that the following equation (32) is established as $$(I31)^{\frac{1}{2}}=\{1-(1/K12)^{\frac{1}{2}}\}/(\beta^{\frac{1}{2}}\cdot R31) \quad (32)$$

As a result, the drain currents I31 and I32 will become as follows:

$$I31=[\{(K12)^{\frac{1}{2}}-1\}/(K12)^{\frac{1}{2}}]^2\cdot[1/\{\beta\cdot(R31)^2\}] \quad (33)$$

$$I32=[\{(K12)^{\frac{1}{2}}-1\}/(K12)]^2\cdot[1/\{\beta\cdot(R31)^2\}] \quad (34)$$

The output current I0 of the constant current circuit 11 is a current of K13 times the drain current I32, so that the output current I0 can be expressed as follows:

$$I0=K13\cdot[\{(K12)^{\frac{1}{2}}-1\}/(K12)]^2\cdot[1/\{\beta\cdot(R31)^2\}] \quad (35)$$

Here, suppose that the current I31 is proportional to the current I0, namely, the currents I31 and I0 can be expressed as $$I31=b\cdot I0 \quad (36)$$

where b is constant.

From the equation (25), the reference voltage VREF can be obtained as follows:

$$VREF=(b\cdot I_0/\beta)^{\frac{1}{2}}\cdot[1+(R21/R23)\cdot\{1-(a/K11)^{\frac{1}{2}}\}]+VTH \quad (37)$$

By substituting the equation (35) into the equation (37), the reference voltage VREF can be expressed as follows:

$$VREF=\{(b\cdot K13)^{\frac{1}{2}}/(\beta\cdot R11)\}\cdot[\{(K12)^{\frac{1}{2}}-1\}/K12\}]\times[1+(R21/R23)\cdot\{1-(a/K11)^{\frac{1}{2}}\}]+V_{TH} \quad (38)$$

Next, explanations will be made on the offset generator 13.

In the offset generator 13, a differential pair formed of N-channel MOS transistors M41 and M42 and a N-channel MOS transistor M48 which is a constant current source for driving the differential pair form a differential circuit. P-channel MOS transistors M43 and M44 form an active load of the differential circuit.

An N-channel MOS transistor M45 and an N-channel MOS transistor M49 which is a constant current source for driving the transistor M45 form a level shift circuit. A capacitor C41, an N-channel MOS transistor M50 and a P-channel MOS transistor M51 form a phase compensation circuit. A P-channel MOS transistor M46 and an N-channel MOS transistor M47 form an output circuit for outputting the desired constant voltage.

In the differential circuit, the reference voltage VREF outputted from the reference voltage generator 12 is applied to the gate of one transistor M41 forming the differential pair and the output voltage VOUT is applied from the output circuit to the gate of the transistor M42. The transistor M48 for driving the differential pair has the source connected directly to the earth and the gate connected to the drain of the transistor M31 of the constant current circuit 11. The transistors M43 and M44 as an active load are provided between the differential pair and a power source (supply voltage VDD). The output of the differential circuit is respectively delivered through the gates of the transistors M45 and M46 to the level shift circuit and the output circuit.

The transistors M41 and M42 forming the differential pair have a capacity ratio as to be (W/L)41:(L/W)42=1:K14, thus forming so-called unbalanced differential pair. The transistor M48 for driving the differential pair has a capacity ratio to the transistor M42 as to be (W/L)41:(L/W)48=1:K16. The transistors M43 and M44 as an active load has a capacity ratio as to be (W/L)43:(L/W)44=K15:1, becoming so-called unbalanced differential pair as well. As shown above, the differential circuit becomes a circuit having an input offset (voltage VOS).

In the level shift circuit, the output of the differential circuit is applied to the gate of the transistor M45. The gate of the transistor M49 for driving the transistor M45 is connected to the drain of the transistor M31 of the constant current circuit 11.

In the output circuit, the output of the differential circuit is applied to the gate of the transistor M46, and the gate of the transistor M47 for driving the transistor M46 is connected to the drain of the transistor M49. The transistor M46 is a voltage pass element to output the constant voltage VOUT.

In the phase compensation circuit, the transistors M50 and M51 serve to function equivalently as a resistor thereby to perform the phase compensation between the input and output of the output circuit together with the capacitor C41.

Next, the operation of the offset generator 13 will be explained below.

First, in the differential circuit, if transconductance parameter of the transistor M41 is expressed as $\beta'$, transconductance parameter of the transistor M42 becomes $(K14\cdot\beta')$, so that the drain currents I41 and I42 of the transistors M41 and M42 can be expressed as follows:

$$I41=\beta'\cdot(VGS41-VTH)^2 \quad (39)$$

$$I42=K14\cdot\beta'\cdot(VGS42-VTH)^2 \quad (40)$$

The sum of the drain currents I41 and I42 can be shown as $$I41+I42=K16\cdot I32 \quad (41)$$

The offset voltage VOS can be expressed as the difference of the respective gate-to-source voltages VGS41 and VGS42 of the transistors M41 and M42, or $$VOS = VGS41 - VGS42 \quad (42)$$

The active load formed of the transistors M43 and M44 as an unbalanced differential pair forms a current mirror circuit and operates so as to keep the relationship of being I41=(K15·I42), and from this relationship and the equation (41), the drain currents I41 and I42 can be obtained as follows:

$$I41 = \{K15 \cdot K16/(K15+1)\} \cdot I42 \quad (43)$$

$$I42 = \{K16/(K15+1)\} \cdot I42 \quad (44)$$

Here, by substituting the equations (43) and (44) respectively into the equations (39) and (40), and by arranging them using the equation (42), the offset voltage VOS can be obtained as follows:

$$VOS = -(I32/\beta')^{\frac{1}{2}} \times \{K15 \cdot K16/(K15+1)\}^{\frac{1}{2}} \cdot \{1 - 1/(K14 \cdot K15)^{\frac{1}{2}}\}\} \quad (45)$$

Here, if $(\beta'/\beta)$=K17 and the term of the drain current I32 is eliminated by substituting the equation (34) into the equation (35), the offset voltage VOS can be expressed as follows:

$$VOS = \{1/(\beta \cdot R31)\} \cdot [(K15 \cdot K16)/\{K17 \cdot (K15+1)\}]^{\frac{1}{2}} \times \{1 - 1/(K14 \cdot K15)^{\frac{1}{2}}\}\} \quad (46)$$

From the equation (46), it can be found that the offset voltage VOS is inversely proportional to the square root of transconductance parameter $\beta$.

Since the output voltage VOUT of the constant voltage circuit can be shown as $$VOUT = VREF - VOS,$$

by substituting the equations (38) and (39) into this, the output voltage VOUT can be expressed as follows:

$$VOUT = (1/\beta \cdot R31) \cdot (1/K12) \cdot (b \cdot K13)^{\frac{1}{2}} \cdot \{(K12)^{\frac{1}{2}} - 1\} \times [1 + (R21/R23) \cdot \{1 - (a/K11)^{\frac{1}{2}}\}] - [(K15 \cdot K16)/\{K17 \cdot (K15+1)\}]^{\frac{1}{2}} \cdot [1 - \{1/(K14 \cdot K15)^{\frac{1}{2}}\}] + VTH \quad (47)$$

Referring to the reference literature titled as "MOS Integrated Circuits" by W. M. Penny and L. Lau, published by Van Nostrand Company, the threshold voltage VTH is about −2.7 mV/deg in low threshold voltage process and as a result, the following equation (48) will be established as $$dVTH/dT = -2.7(mV/deg) \quad (48)$$

Besides, the transconductance parameter $\beta$ can be expressed in terms of the electron mobility $\mu n$, the gate oxide film capacity perunit area COX, the gate width W and the gate length L as $$\beta = \mu n \cdot (COX/2) \quad (49)$$

The mobility fin can be expressed as the primary approximation of its temperature characteristic as $$1/\mu n(T) = \{1/\mu n(T0)\} \cdot (T/T0)^{3/2} \quad (50)$$

As a result, $(1/\beta)$ can be expressed as follows:

$$1/\beta = (1/\beta 0) \cdot (T/T0)^{3/2} \quad (51)$$

where, $\beta 0$ is a transconductance parameter $\beta$ at absolute temperature T0, meaning $\beta(T0)$.

if T0=300K, by differentiating the equation (51) with respect to absolute temperature T, the following equation (52) can be obtained:

$$\{d(1/\beta)/dT\}(T=300K) = 0.005/deg \quad (52)$$

Here, by differentiating the equation (47) with respect to the absolute temperature T, the following equation (53) can be obtained as $$dVOUT/dT = (3/2) \cdot [T^{\frac{1}{2}}/\{\beta 0 \cdot R31 \cdot (T0)^{3/2}\}] \times [(1/K12) \cdot (b \cdot K13)^{\frac{1}{2}} \cdot \{(K12)^{\frac{1}{2}} - 1\} \cdot \{1 + (R21/R23)\} \times \{1 - (a/K11)^{\frac{1}{2}}\} - [(K15 \cdot K16)/\{K17 \cdot (K15+1)\}]^{\frac{1}{2}} \times [1 - \{1/(K14 \cdot K15)^{\frac{1}{2}}\}]] - \{1/\beta 0 \cdot (R31)^2\} \cdot (T/T0)^{3/2} \times [(1/K12) \cdot [(b \cdot K13)^{\frac{1}{2}} \cdot \{(K12)^{\frac{1}{2}} - 1\}] \times [1 + (R21/R23) \cdot \{1 - (a/K11)^{\frac{1}{2}}\}] - [(K15 \cdot K16)/\{K17 \cdot (K15+1)\}]^{\frac{1}{2}} \times [1 - \{1/(K14 \cdot K15)^{\frac{1}{2}}\}]] \cdot (dR31/dT) + (dVTH/dT) \quad (53)$$

In the equation (53), if T=To, the following equation (54) can be obtained as $$(dVOUT/dT)|(T=T0) = (3/2)(1/\beta_0 \cdot R31 \cdot T_0) \times [(1/K12) \cdot [(b \cdot K13)^{\frac{1}{2}} \cdot \{(K12)^{\frac{1}{2}} - 1\}] \times \{1 + (R21/R23)\} \cdot \{1 - (a/K11)^{\frac{1}{2}}\} - [(K15 \cdot K16)/\{K17 \cdot (K15+1)\}]^{\frac{1}{2}} \cdot [1 - \{1/(K14 \cdot K15)^{\frac{1}{2}}\}]] - \{1/\beta 0 \cdot (R31)^2\} \cdot [(1/K12) \cdot [(b \cdot K13)^{\frac{1}{2}} \cdot \{(K12)^{\frac{1}{2}} - 1\}] \times [1 + (R21/R23) \cdot \{1 - (a/K11)^{\frac{1}{2}}\}] - [(K15 \cdot K16)/\{K17 \cdot (K15+1)\}]^{\frac{1}{2}} \times [1 - \{1/(K14 \cdot K15)^{\frac{1}{2}}\}]] \cdot (dR31/dT)|(T=T0) + (dVTH/dT)|(T=T0) \quad (54)$$

In the equation (54), if T0=300K, the following equation (55) can be obtained as $$(dVOUT/dT)|(T=300\,K) = \{0.005 - (1/R31) \cdot (dR31/dT)|(T=300\,K)\} \cdot \{1/(\beta 0 \cdot R31)\} \times [(1/K12) \cdot (b \cdot K13)^{\frac{1}{2}} \cdot \{(K12)^{\frac{1}{2}} - 1\} \cdot \{1 + (R21/R23)\} \times \{1 - (a/K11)^{\frac{1}{2}}\} - [(K15 \cdot K16)/\{K17 \cdot (K15+1)\}]^{\frac{1}{2}} \times [1 - \{1/(K14 \cdot K15)^{\frac{1}{2}}\}]] + (dVTH/dT)|(T=300\,K) \quad (55)$$

If the differentiated value of the output voltage VOUT with respect to the temperature at T=300K is made zero (0), from the equation (48), the following equation (56) can be obtained as $$\{0.005 - (1/R31) \cdot (dR31/dT)|(T=300K)\} \cdot (1/\beta 0 \cdot R31) \times \quad (56)$$

-continued $$[(1/K12)\cdot(b\cdot K13)^{\frac{1}{2}}\cdot\{(K12)^{\frac{1}{2}}-1\}\cdot\{1+(R21/R23)\}\times\{1-(a/K11)^{\frac{1}{2}}\}-[(K15\cdot K16)/\{K17\cdot(K15+1)\}]^{\frac{1}{2}}\times[1-\{1/(K14\cdot K15)^{\frac{1}{2}}\}]\}=2.7\ \mathrm{mV/deg}$$

For example, if (1/R31)·(dR31/dT)=0.0006/deg at T=300K, in case of satisfying the following equation (57), (dVOUT/dT)=0 can be obtained at T=300K.

$$(1/\beta 0\cdot R31)\cdot[(1/K12)\cdot(b\cdot K13)^{\frac{1}{2}}\cdot\{(K12)^{\frac{1}{2}}-1\}\times\{1+(R21/R23)\}\cdot\{1-(a/K11)^{\frac{1}{2}}\}-[(K15\cdot K16)/\{K17\cdot(K15+1)\}]^{\frac{1}{2}}\cdot[1-\{1/(K14\cdot K15)^{\frac{1}{2}}\}]]=0.614\ V \quad (57)$$

As a result, when T=300K, if VTH=0.7 V, then, VOUT=1.314 V, thus the temperature characteristic of the output voltage VOUT becoming zero.

From the equation (46), the magnitude of the offset voltage VOS can be determined by the resistance R13, and the constant values K14, K15, K16 and K17. Therefore, by adjusting these values, the temperature characteristic of the output voltage VOUT expressed not only as $$VOUT=VREF-VOS$$

but also by the equation (53) can be arbitrarily set. For example, the temperature characteristic of the output voltage VOUT can be set to any positive or negative value arbitrarily.

Figure 6:
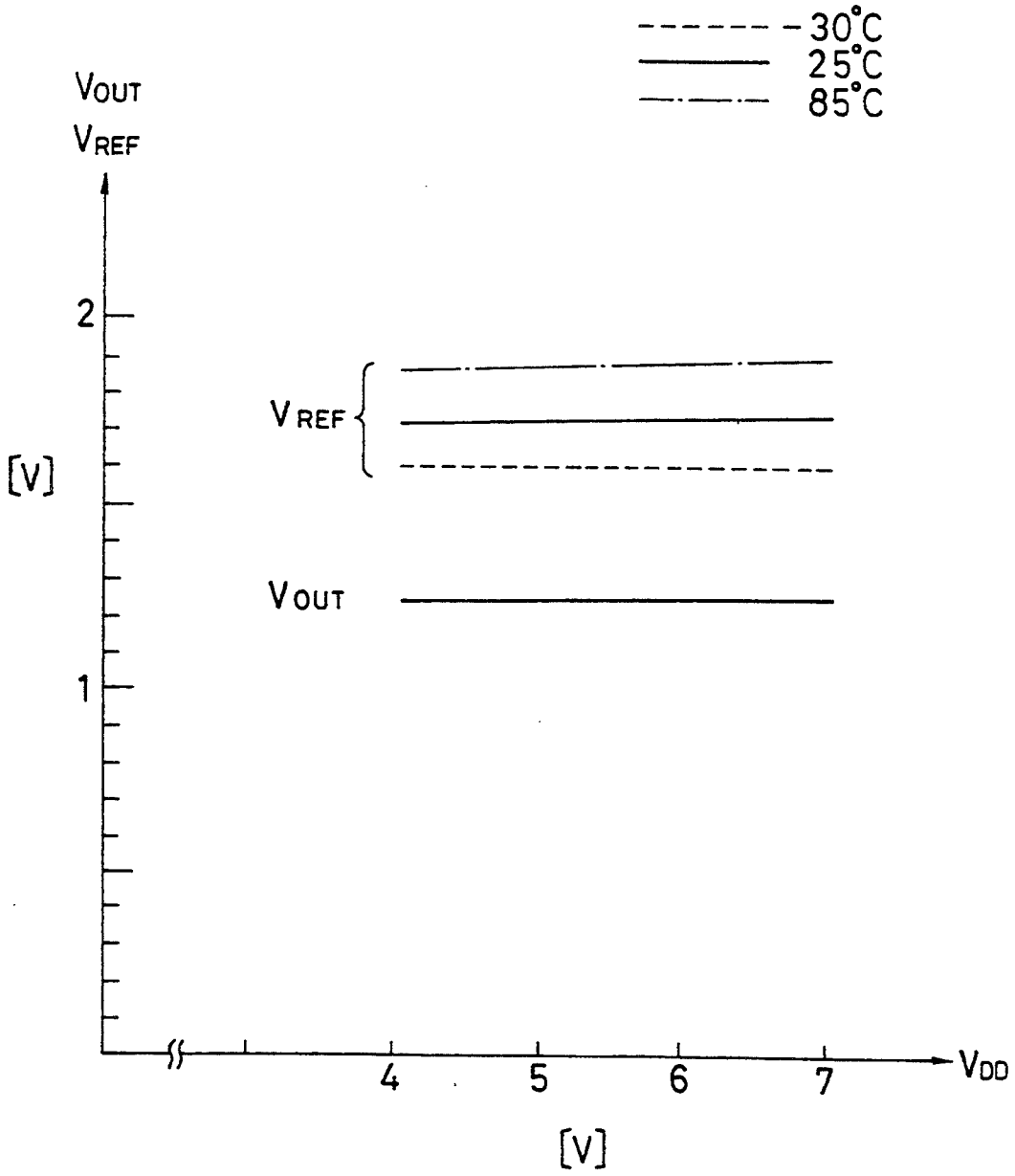
FIG. 6 is a temperature characteristic diagram of an output voltage of the constant voltage circuit of the fifth embodiment obtained by a SPICE (MODEL.2) simulation.

FIG. 6 shows the temperature characteristics of the output voltage of the constant voltage circuit of this embodiment, which were obtained by the SPICE (MODEL.2) simulation technology, and in which the range of VDD≧4 V is shown. It can be found from FIG. 6 that the reference voltage VREF has a positive temperature characteristic which is increased with an increase in temperature and on the other hand, the output voltage VOUT is substantially constant independently of the temperature and the temperature characteristic thereof becomes substantially zero, The simulation conditions were the temperature characteristic of resistor=0.0006/deg, (W/L) value of the transistors M11 and M12 of the constant current circuit 11 is (50 μm/5 μm), VTH=0.76 V, R31=1.8K Ω, R21=R22=6K Ω, R23=900Ω, K11=2, K12=4, K13=2, K14=4, K15=4, K16=½ and tox (gate oxide film thickness)=280 Å.

As explained above, in the constant voltage circuit of this fifth embodiment, the reference voltage generator 12 and offset generator 13 are driven by the constant current circuit 11 having a temperature characteristic, and the reference voltage VREF outputted from the reference voltage generator 12 is subjected to temperature compensation by the offset generator 13, thus obtaining a constant voltage having the desired characteristics, In addition, the temperature characteristic of the output voltage of the offset generator 13 can be set to any positive or negative value or zero arbitrarily.

Consequently, the constant voltage circuit of this embodiment can be appropriately realized on a MOS integrated circuit.

[Sixth Embodiment]

Figure 7:
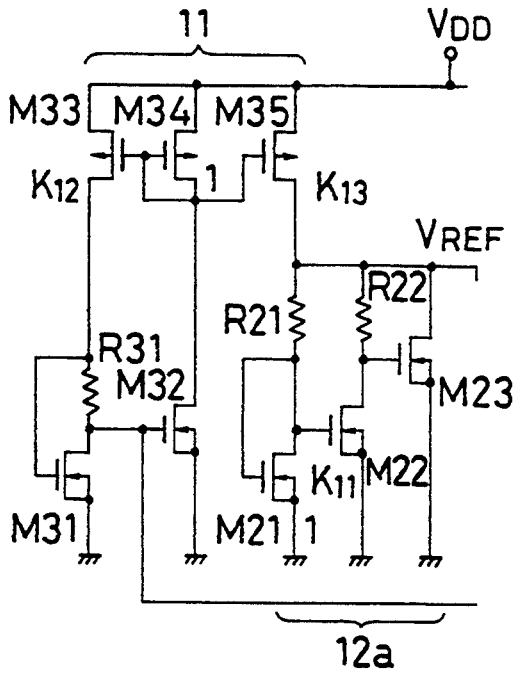
FIG. 7 is a partial circuit diagram of a constant voltage circuit according to a sixth embodiment of this invention.

FIG. 7 shows a constant current circuit and a reference voltage generator of a constant voltage circuit according to a sixth embodiment of this invention, which is a modification example of the fifth embodiment.

A reference voltage generator 12*a* shown in FIG. 7 is similar in structure to the reference voltage generator 12 shown in FIG. 5 excepting that the resistor R23 is omitted in FIG. 5 and the gate and drain of the MOS transistor M21 are connected directly to each other. In this case, an internal resistance between the source and drain of the transistor M21 is utilized.

Such circuit makes it possible to obtain the same effects as those of the fifth embodiment.

[Seventh Embodiment]

Figure 8:
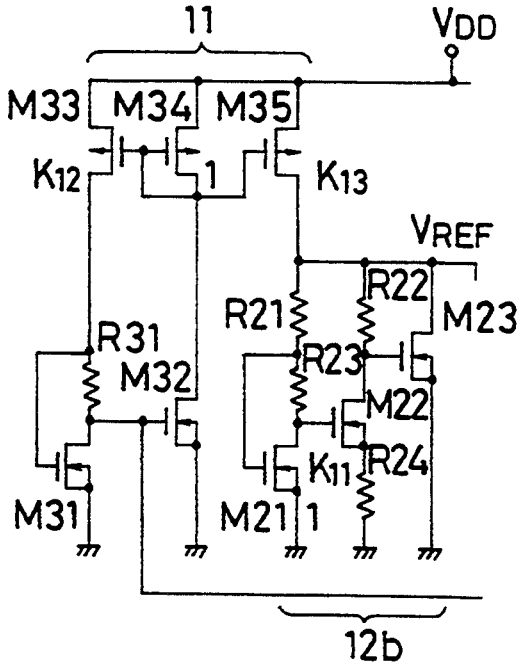
FIG. 8 is a partial circuit diagram of a constant voltage circuit according to a seventh embodiment of this invention.

FIG. 8 shows a constant current circuit and a reference voltage generator of a constant voltage circuit according to a seventh embodiment of this invention, which is also a modification example of the fifth embodiment.

A reference voltage generator 12*b* is similar in structure to the reference voltage generator 12 shown in FIG. 5 excepting that a resistor R24 is provided between the source of the MOS transistor M22 and the earth and the source thereof is connected through the resistor R24 to the earth.

Such circuit can obtain the same effects as those of the fifth embodiment.

[Eighth Embodiment]

Figure 9:
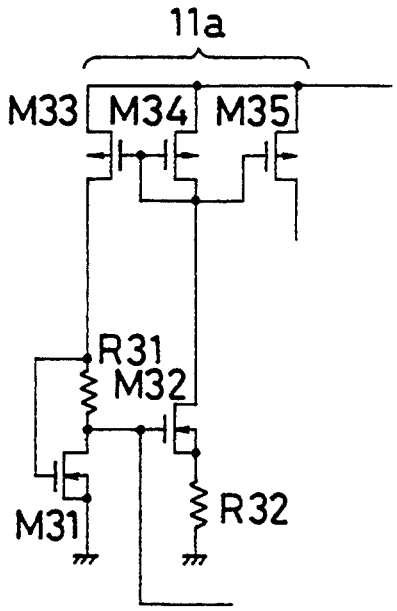
FIG. 9 is a partial circuit diagram of a constant voltage circuit according to a eighth embodiment of this invention.

FIG. 9 shows a constant current circuit of a constant voltage circuit according to an eighth embodiment of this invention, which is also a modification example of the fifth embodiment.

The constant current circuit 11*a* is similar in structure to the constant current circuit 11 shown in FIG. 5 excepting that a resistor R32 is provided between the source of the MOS transistor M31 and the earth and the source thereof is connected through the resistor R32 to the earth.

Such circuit can obtain the same effects as those of the fifth embodiment.

[Ninth Embodiment]

Figure 10:
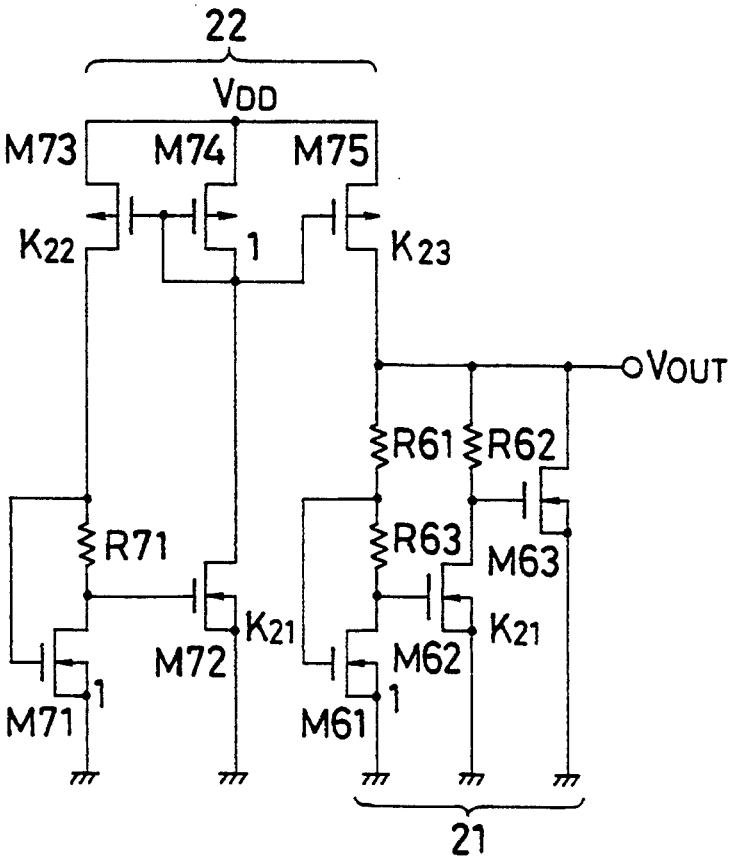
FIG. 10 is a circuit diagram of a reference voltage generating circuit according to a ninth embodiment of this invention.

FIG. 10 shows a reference voltage generator according to a ninth embodiment of this invention, which comprises a constant voltage generator 21 and a constant current circuit 22 and in which the reference voltage VOUT is outputted to the connecting end of the both circuits 21 and 22.

The constant voltage generator 21 comprises three N-channel MOS transistors M61, M62 and M63. The transistor M61 has the source connected directly to the earth, the gate connected through a resistor R61 to the output side of the constant current circuit 22 and the drain connected through a resistor R63 to the resistor R61. Namely, the drain of the transistor M61 is connected through the resistors R61 and R63 disposed in series to the output side of the constant current circuit 22.

The transistor M62 has the source connected directly to the earth, the gate connected to the drain of the transistor M61 and the drain connected through a resistor R62 to the output side of the constant current circuit 22.

The transistor M63 has the source connected directly to the earth, the gate connected to the drain of the transistor M62 and the drain connected to the output side of the constant current circuit 22.

The transistors M61 and M62 form a peaking current mirror circuit, the capacity ratio of which is made as to be (W/L)61:(L/W)62=1:K21.

The constant current circuit 22 comprises two N-channel MOS transistors M71 and M72 and three P-channel MOS transistors M73, M74 and M75, thus forming so-called complementary (C) MOS structure.

The transistor M71 has the source connected directly to the earth, the gate connected through R71 to the drain thereof and the drain connected to the drain of the transistor M73. The transistor M72 has the source connected directly to the earth, the gate connected to the drain of the transistor M71 and the drain connected to the drain of the transistor M74. The transistors M71 and M72 form a peaking current mirror circuit, the capacity ratio of which is made as to be (W/L)71:(L/W)72=1:K21.

The transistors M73 and M74 form a simple current mirror circuit for driving the transistors M71 and M72 whose capacity ratio is made as to be (W/L)74:(L/W)73=1:K22. The transistor M74 and M75 form a simple current mirror circuit for supplying a driving current to the constant voltage generator 21, the capacity ratio of which is made as to be (W/L)74:(L/W)73=1:K23.

The drain of the transistor M75 is connected to the drain of the transistor M61 of the constant voltage generator 21 through the resistors R61 and R63 and to the drain of the transistor M62 through the resistor R62 as well as connected directly to the drain of the transistor M63. A predetermined constant voltage is outputted to the connecting point of them.

The operation of the reference voltage generator as structured above will be explained below.

In the constant voltage generator 21, if the drain currents (driving currents) of the transistors M61, M62 and M63 are expressed as I61, I62 and I63 and the gate-to-source voltages thereof are expressed as VGS61, VGS62 and VGS63 respectively, the following equations will be obtained as $$VOUT = VGS61 + R61 \cdot I61$$

$$VGS61 - VGS62 = R63 \cdot I61$$

As a result, from these equations, the output voltage VOUT can be expressed as follows:

$$VOUT = VGS61 + (R61/R63) \cdot (VGS61 - VGS62) \quad (58)$$

On the other hand, if the threshold voltage and transconductance parameter of the transistor M61 is expressed as VTH and $\beta 61$, respectively, the drain currents I61 and I62 can be expressed as follows:

$$I61 = \beta 61 \cdot (VGS61 - VTH)^2 \quad (59)$$

$$I62 = K21 \cdot \beta 61 \cdot (VGS62 - VTH)^2 \quad (60)$$

As a result, by substituting the equations (59) and (60) into the equation (58), the output voltage VOUT can be obtained as $$\begin{aligned} VOUT &= (I61/\beta 61)^{\frac{1}{2}} + VTH + \\ &\quad (R61/R63) \cdot [(I61/\beta 61)^{\frac{1}{2}} - \{I62/(K61 \cdot \beta 61)\}^{\frac{1}{2}}] \\ &= \{1/(\beta 61)^{\frac{1}{2}}\} \times [(I61)^{\frac{1}{2}} \cdot \\ &\quad \{1 + (R61/R63)\} - (R61/R63) \cdot (I62/K61)^{\frac{1}{2}}\}] + \\ &\quad VTH \end{aligned} \quad (61)$$

From the equation (61), it can be found that the drain currents I61 and I62 each is subjected to root compression so that the variation width of the output voltage VOUT is compressed responsively to the change of the drain currents I61 and I62.

If the output current of the constant current circuit 22 is expressed as Io', it is equal to the drain current of the transistor M75, thus the following equation being established as $$I61 + I62 + I63 = I0' \quad (62)$$

From which, it can be found that the gate voltage of the transistor M63 increases with an increase in output voltage VOUT and as a result, an increase in the drain current I63 results in the reduction of the sum of the drain currents I61 and I62, or (I61+I62). This means that the output voltage VOUT is varied, the negative feedback is taken so as to cancel the variation thereof. Accordingly, the output voltage VOUT expressed by the equation (61) can take a substantially constant value even if the drain currents I61 and I62 are varied.

Consequently, the transistors M61, M62 and M63 generate the constant voltage VOUT.

Here, if transconductance parameter of the transistor M63 is expressed as $\beta 63$, the drain current I63 of the same can be expressed as follows:

$$I63 = \beta 63 \cdot (VGS63 - VTH)^2 \quad (63)$$

In this case, if transconductance parameter $\beta 61$ of the transistor M61 and transconductance parameter $\beta 63$ of the transistor M63 are related as $$\beta 63 > \beta 61 > 1 \quad (64)$$

the transconductance of the transistor M63 becomes large, so that the regulation of the output voltage VOUT can be advantageously improved.

If the equation (64) is established, so-called peaking characteristic is appeared in the relation of the drain currents I61 and I62 and the current I62 is increased as the current I61 increases, however, such change gradually becomes small to be reduced further.

Next, the operation of the constant current circuit 22 will be explained below.

In the constant current circuit 22, if transconductance parameter of the transistor M71 is expressed as $\beta''$, the drain current I71 of the transistor M71 and the drain current I72 of the transistor M72 can be expressed as follows:

$$I71 = (\beta'') \cdot (VGS71 - VTH)^2 \quad (65)$$

$$I72 = (\beta'') \cdot (VGS72 - VTH)^2 \quad (66)$$

The difference of the gate-to-source voltage VGS71 of the transistor M71 and the gate-to-source voltage VGS72 of the transistor M72 can be shown as follows:

$$VGS71-VGS72=R71\cdot I71 \quad (67)$$

The capacity ratio of the transistors M73 and M74 forming the current mirror circuit is K22:1 and as a result, the drain currents I71 and I72 can be related as $$I71=K22\cdot I72 \quad (68)$$

From the equations (65) to (68), the following equation (69) can be obtained and by arranging it, the following equation (70) can be obtained:

$$I71\cdot R71=(I71/\beta'')^{\frac{1}{2}}-\{I71/(K22\cdot\beta'')\}^{\frac{1}{2}} \quad (69)$$

$$(I71)^{\frac{1}{2}}\cdot[(\beta'')^{\frac{1}{2}}\cdot R71\cdot(I71)^{\frac{1}{2}}-\{1-1/(K22)^{\frac{1}{2}}\}]=0 \quad (70)$$

Here, I71>0, so that the equation (70) can be made as follows:

$$(I71)^{\frac{1}{2}}=[1-\{1/(K22)^{\frac{1}{2}}\}]/\{(\beta'')^{\frac{1}{2}}\cdot R71\} \quad (71)$$

As a result, the drain currents I71 and I72 can be obtained as follows:

$$I71=[\{(K22)^{\frac{1}{2}}-1\}/(K22)^{\frac{1}{2}}]^2\cdot[1/\{(\beta'')\cdot(R71)^2\}] \quad (72)$$

$$I72=[\{(K22)^{\frac{1}{2}}-1\}/K22]^2\cdot[(1/\{(\beta'')\cdot(R71)^2\}] \quad (73)$$

Since the output current I0' of the constant current circuit 22 is of K23 times the drain current I72, it can be expressed as follows:

$$I0'=K23\cdot[\{(K22)^{\frac{1}{2}}-1\}/K22]^2\cdot[(1/\{(\beta'')\cdot(R71)^2\}] \quad (74)$$

For example, suppose that the drain currents I71 and I72 can be respectively expressed in terms of the output current Io' as $$I71=c\cdot I0' \quad (75)$$

$$I72=d\cdot I0' \quad (76)$$

where c and d are arbitrarily constant smaller than or equal to one (1).

From the equation (62), the drain current I73 of the transistor M73 can be expressed as follows:

$$I73=\{1-(c+d)\}\cdot I0' \quad (77)$$

As a result, by substituting the equation (75) and (76) into the equation (61), the output voltage VOUT becomes as follows:

$$VOUT=(I_o'/\beta'')^{\frac{1}{2}}\times[c^{\frac{1}{2}}\cdot\{1+(R61/R63)\}-(R61/R63)\cdot(d/K21)^{\frac{1}{2}}]+VTH \quad (78)$$

By substituting the equation (74) into the equation (78), the following equation (79) can be obtained:

$$VOUT=\{(K23)^{\frac{1}{2}}/(\beta\cdot R11)\}\cdot[\{(K22)^{\frac{1}{2}}-1\}/K22]\times[c^{\frac{1}{2}}\cdot\{1+(R61/R63)\}-(R61/R63)\cdot(d/K21)^{\frac{1}{2}}]+VTH \quad (79)$$

where $|d\beta''/dT|>>|dR71/dT|$ is supposed and the temperature characteristic term of the resistor R71, or $|dR71/dT|$ is neglected.

Here, if the equation (64) is established and the resistance value of the resistor R63 is set so that the peaking characteristic is appeared, the respective ratios between the drain currents I61, I62 and I63 become substantially constant. This means that the three transistors M61, M62 and M63 can be seen to form a dividing circuit for dividing the output current Io' at a constant current ratio.

In this case, according to the reference literature titled as "MOS Integrated Circuits" already mentioned above, the threshold voltage VTH in the equation (79) is about −2.7 mV/deg in the low threshold voltage process. Thus, the following equation can be established $$dVTH/dT=-2.7\ mV/deg \quad (80)$$

Transconductance parameter $\beta''$ can be expressed interms of the electron mobility $\mu n$, the gate oxide film-capacity per unit area COX, the gate width W, and the gatelength L as $$\beta''=\mu n\cdot(COX/2)\cdot(W/L) \quad (81)$$

The temperature characteristic of the mobility $\mu n$ can be expressed as the primary approximation as $$1/\mu n(T)=\{1/\mu n(T0)\}\cdot(T/T0)^{-3/2} \quad (82)$$

Then, $(1/\beta'')$ can be expressed as follows:

$$1/\beta''=\{1/(\beta 0'')\}\cdot(T/T0)^{3/2} \quad (83)$$

where $\beta 0''$ means $\beta''(T0)$.

If To=300K, the differentiated value of the equation (83) with respect to the absolute temperature can be expressed as follows:

$$d(1/\beta'')/dT=0.005/deg \quad (84)$$

As a numerical example, if VTH=0.7 V and VOUT=1.24 V, the following equation can be obtained as $$\{(K23)^{\frac{1}{2}}/(\beta 0''\cdot R71)\}\cdot[\{(K22)^{\frac{1}{2}}-1\}/K22]\times[c^{\frac{1}{2}}\cdot\{1+(-R61/R63)\}-(R61/R63)\cdot(d/K21)^{\frac{1}{2}}]=0.54\ V \quad (85)$$

From the equations (80), (84) and (85), the differentiated value of the output voltage VOUT with respect to the absolute temperature will become as follows:

$$dVOUT/dT=(0.54\ V)\times(0.005/deg)+(-2.7\ mV/deg)=0 \quad (86)$$

This means that the temperature characteristic of the output voltage VOUT becomes zero.

In the SPICE (MODEL.2) simulation using a practical device parameter, R71, K21, K22, K23, R61, R62 and R63 can be set so as to establish $(dVOUT/dT)\approx 0$.

Figure 11:
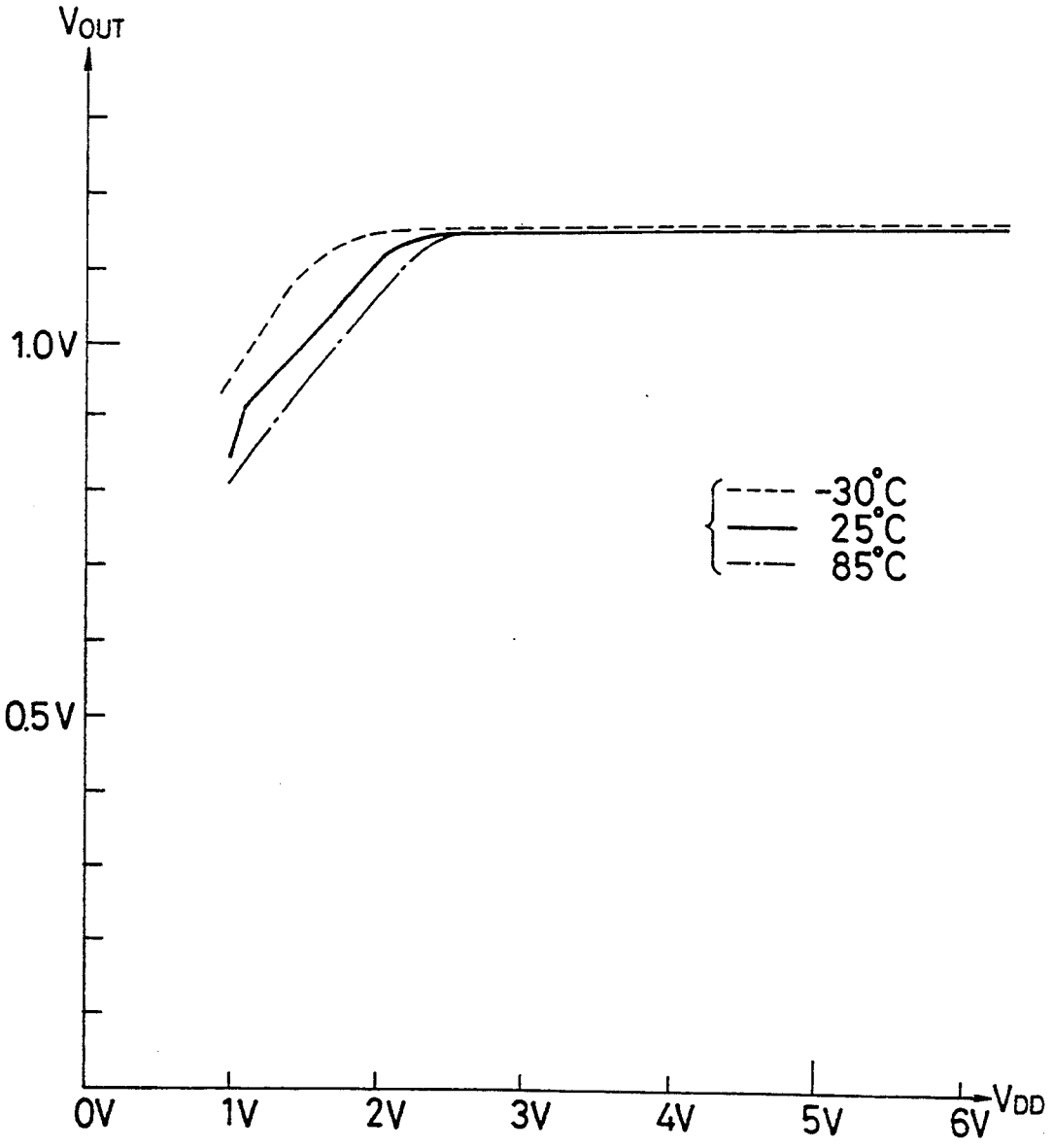
FIG. 11 is a temperature characteristic diagram of the reference voltage generating circuit of the ninth embodiment by a SPICE (MODEL.2) simulation.

FIG. 11 shows the results of the SPICE (MODEL.2) simulation of the reference voltage generator of this embodiment. From which it can be found that if VDD>2.5 V, the temperature characteristic of the output voltage VOUT becomes substantially zero.

The simulation conditions were the temperature characteristic of resistor=0.0006/deg, (W/L) of the transistors M71 and M72 of the constant current generator 22 is (50 μm/5 μm), (W/L) of the transistors M61 and M62 of the constant voltage generator 21 is (50 μm/1.5 μm), (W/L) of the transistor M63 is (150 μm/1.5 μm), VTH=0.76 V, R71=1.8K Ω, R61=R62=3.0K Ω, R63=960Ω, K21=2, K22=4, K23=2 and tox=280 Å.

As explained above, in the reference voltage generator of this ninth embodiment, the constant voltage generator 21 having a peaking characteristic and the constant current circuit 22 for driving the generator 21 are respectively composed of MOS transistors, and the peaking characteristics of the both circuit 21 and 22 can be set so as to cancel the temperature characteristic of the output voltage VOUT, so that the temperature characteristic of the reference voltage VREF to be outputted can be made substantially zero. In addition, it can be realized on a CMOS integrated circuit.

[Tenth Embodiment]

Figure 12:
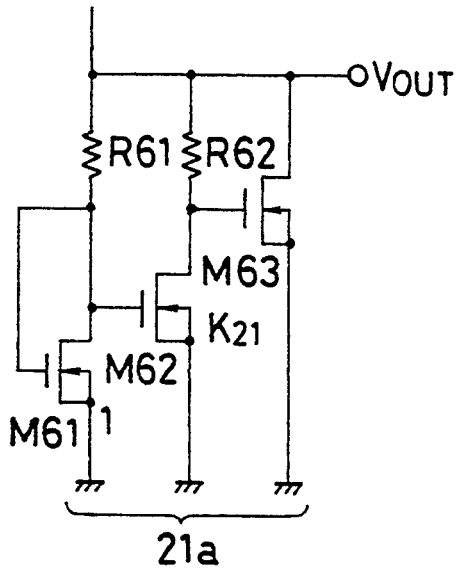
FIG. 12 is a partial circuit diagram of a reference voltage generating circuit according to a tenth embodiment of this invention.

FIG. 12 shows a reference voltage generator according to a tenth embodiment of this invention, which is a modification example of the ninth embodiment.

In FIG. 12, a constant voltage generator 21*a* is similar in structure to the constant voltage generator 21 of the ninth embodiment excepting that the resistor R63 is omitted in FIG. 10 and the gate and drain of the transistor M61 are connected directly to each other. In this case, an internal resistance between the gate and drain of the transistor M61 is utilized.

Such circuit can obtain the same effect as those of the ninth embodiment.

The resistor R63 thus omitted therefrom may be disposed between the source of the transistor 62 and the earth as shown in the following eleventh embodiment.

[Eleventh Embodiment]

Figure 13:
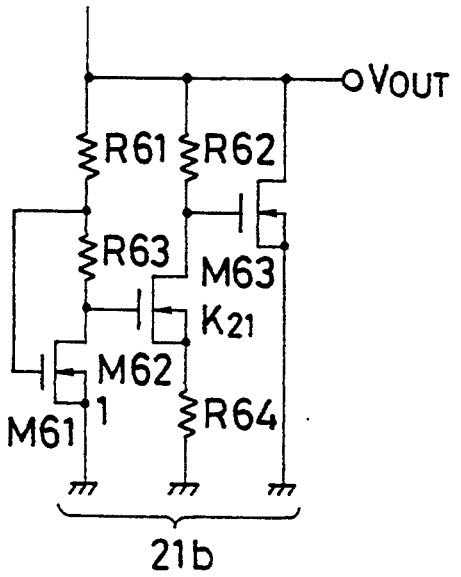
FIG. 13 is a partial circuit diagram of a reference voltage generating circuit according to an eleventh embodiment of this invention.

FIG. 13 shows a reference voltage generator according to an eleventh embodiment of this invention, which is a modification example of the ninth embodiment.

In FIG. 13, a constant voltage generator 21*b* is similar in structure to the constant voltage generator 21 of the ninth embodiment excepting that a resistor R64 is provided between the source of the MOS transistor M62 and the earth and the source thereof is connected through the resistor R64 to the earth.

The resistor R63 connected to the drain of the transistor M61 can be omitted as in the tenth embodiment shown in FIG. 12.

[Twelfth Embodiment]

Figure 14:
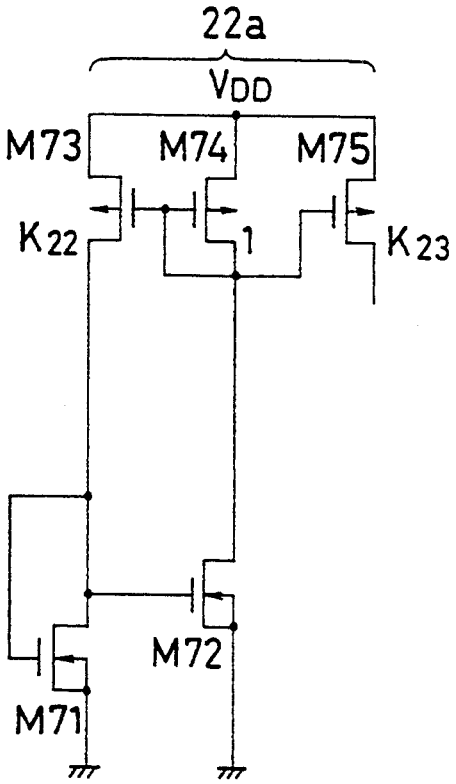
FIG. 14 is a circuit diagram of a reference voltage generating circuit according to a twelfth embodiment of this invention.

FIG. 14 shows a reference voltage generator according to a twelfth embodiment of this invention, which is also a modification example of the ninth embodiment.

In FIG. 14, a constant current circuit 22*a* is similar in structure to the constant current circuit 22 of the ninth embodiment excepting that the resistor R71 connected to the drain of the transistor M71 shown in FIG. 10 is omitted and the gate and drain of the transistor M71 are connected directly to each other.

The resistor R71 thus omitted therefrom may be disposed between the source of the transistor M72 and the earth as shown in the following thirteenth embodiment of this invention.

[Thirteenth Embodiment]

Figure 15:
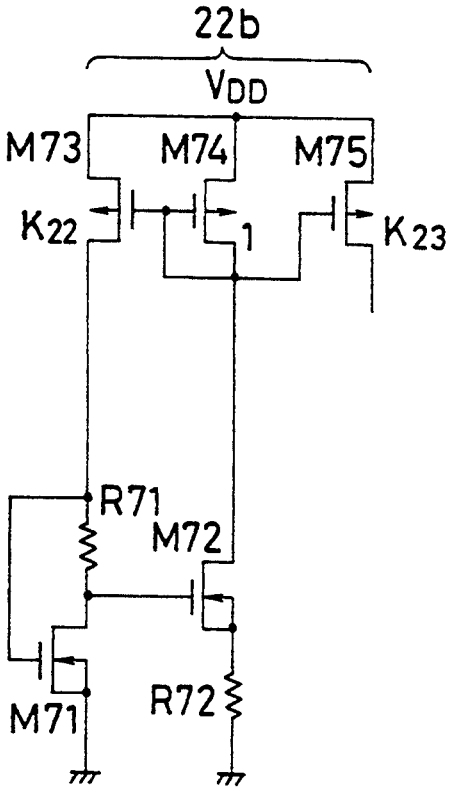
FIG. 15 is a circuit diagram of a reference voltage generating circuit according to a thirteenth embodiment of this invention.

FIG. 15 shows a reference voltage generator according to a thirteenth embodiment of this invention, which is also a modification example of the ninth embodiment.

In FIG. 15, a constant current circuit 22*b* is similar in structure to the constant current circuit 22 of the ninth embodiment excepting that a resistor R72 is provided between the source of the MOS transistor M72 and the earth and the source thereof is connected through the resistor R72 to the earth.

The resistor R71 connected to the drain of the transistor M71 can be omitted as the twelfth embodiment shown in FIG. 14.

[Fourteenth Embodiment]

Figure 16:
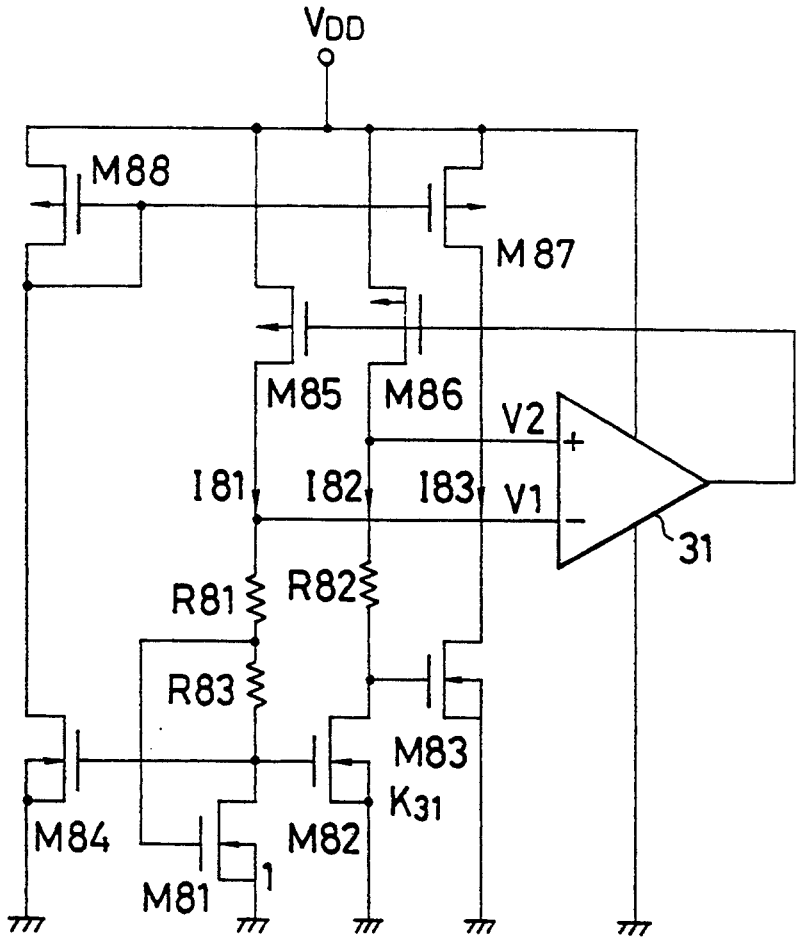
FIG. 16 is a circuit diagram of a reference voltage generating circuit according to a fourteenth embodiment of this invention.

FIG. 16 shows a reference voltage generator according to a fourteenth embodiment of this invention.

A reference voltage generator shown in FIG. 16 comprises four P-channel MOS transistors M85, M86, M87 and M88 provided on the side of a direct current power source VDD, four N-channel MOS transistors M81, M82, M83 and M84 provided on the side of the earth and an operational amplifier 31 composed of MOS transistors.

The transistor M85 forms a first current source and the transistor M86 forms a second current source. The transistors M85 and M86 have the sources respectively connected to a direct current power source (supply voltage VDD) and the gates connected in common to the output end of the operational amplifier 81. The transistor M85 has the drain connected to an inversion input terminal of the operational amplifier 31 as well as to one end of a resistor R81. The transistor M86 has the drain connected to a non-inversion input terminal of the operational amplifier 31 as well as to one end of a resistor R82.

The operational amplifier 31 controls the gate voltages of the transistors M85 and M86 so that a voltage V1 generated at the connecting end of the drain of the transistor M85 and the resistor R81 and a voltage V2 generated at the connecting end of the drain of the transistor M86 and the resistor R82 may be made equal to each other.

The transistor M81 has the source connected directly to the earth, the gate connected to the other end of the resistor R81 and the drain connected through the resistor R83 to the other end of the resistor R81. Namely, the gate of the transistor M81 is connected through the resistor R81 to the drain of the transistor M85 as the first current source and the drain thereof is connected through the resistors R81 and R83 provided in series to the drain of the transistor M85.

The transistor M82 has the source connected directly to the earth, the gate connected to the drain of the transistor M81 and the drain connected through the resistor R82 to the drain of the transistor M86 as the second current source.

The capacity ratio of the transistors M81 and M82 is made as to be (W/L)81:(W/L)82=1:K31.

The transistor M83 has the source connected directly to the earth, the gate connected to the drain of the transistor M82 and the drain connected to the drain of the transistor M87. The transistor M84 has the source connected directly to the earth, the gate connected to the drain of the transistor M81 and the drain connected to the drain of the transistor M88.

The transistors M87 and M88 are connected through the respective sources to the direct current power source VDD thereby to form a current mirror circuit.

The circuit composed of the transistors M83, M84, M87 and M88 controls the transistor M82 so that the characteristic of the drain current I82 of the transistor M82 and the characteristic of the input voltage V2 of the operational amplifier 31 do not effect contrariwise each other. As a result, the control operation of the gate voltages of the transistors M85 and M86 by the operational amplifier 31 can be surely performed.

Here, the expressional saying that "do not effect contrariwise each other" means that when the drain current I2 is increased, the input voltage V2 is not reduced, namely, it is increased or remained constant, further meaning that when the drain current I2 is reduced, the input voltage V2 is not increased, namely, it is reduced or remained constant.

As a result, instead of the circuit composed of the transistors M83, M84, M87 and M88, for example, such a circuit that supplies a constant voltage to the drain of the transistor M82 may be provided.

Next, the operation of the reference voltage generator structured as above will be explained below.

The drain current I81 of the transistor M81 can be expressed in terms of the threshold voltage VTH, the transconductance parameter $\beta 81$ and the gate-to-source voltage VGS81 as $$I81=\beta 81\cdot(VGS81-VTH)^2 \quad (87)$$

The drain current I82 of the transistor M82 can be expressed in terms of the threshold voltage VTH, transconductance parameter ($K31\cdot\beta 81$) and the gate-to-source voltage VGS82 as $$I82=K31\cdot\beta 81\cdot(VGS82-VTH)^2 \quad (88)$$

The gate voltages of the transistors M85 and M86 each is controlled by the output of the operational amplifier 31, so that the drain currents I81 and I82 are equal to each other, or $$I81=I82 \quad (89)$$

Here, the capacity of the transistor M82 is of K31 times that of the transistor M81, so that even if the resistors R81 and R82 are set to be equal in resistance as shown in the following equation (90), its generality is not lost.

$$R81=R82 \quad (90)$$

In this case, one input voltage V1 of the operational amplifier 31 is equal to the drain voltage of the transistor M85 and the other input voltage V2 thereof is equal to the drain voltage of the transistor M86. As a result, the input voltage V1 can be expressed as follows:

$$V1=R81\cdot I81+VGS81=(R81+R83)\cdot I81+VGS82 \quad (91)$$

From the equation (91), the drain current I81 can be obtained as $$I81=(1/R83)\cdot(VGS81-VGS82) \quad (92)$$

Accordingly, the voltage V1 can be expressed as follows:

$$V1=VGS81+(R81/R83)(VGS81-VGS82) \quad (93)$$

Next, from the equations (87) and (88), the following equations are respectively obtained as $$VGS81-VTH=(I81/\beta 81)^{\frac{1}{2}} \quad (94)$$

$$VGS82-VTH=(I82/K31\cdot\beta 81)^{\frac{1}{2}} \quad (95)$$

Here, by substituting the equations (89), (94) and (95) into the equation (92), (VGS81−VGS82) can be expressed as follows:

$$\begin{aligned} VGS81-VGS82 &= (I81/\beta 81)^{\frac{1}{2}}\cdot[1-\{1/(K31)^{\frac{1}{2}}\}] \\ &= I81\cdot R83 \end{aligned} \quad (96)$$

By arranging the equation (96), the following equation (97) can be obtained as $$(I81)^{\frac{1}{2}}\cdot[(I81)^{\frac{1}{2}}\cdot R83-\{1/(\beta 81)^{\frac{1}{2}}\}\cdot[1-\{1/(K31)^{\frac{1}{2}}\}]]=0 \quad (97)$$

Here, I81>0, the following equation (98) can be obtained as $$(I81)^{\frac{1}{2}}=\{1/R83\cdot(\beta 83)^{\frac{1}{2}}\}\cdot[1-\{1/(K31)^{\frac{1}{2}}\}] \quad (98)$$

By substituting the equation (98) into the equation (94), (VGS81−VGS82) can be obtained as follows:

$$VGS81-VTH=(K31)^{\frac{1}{2}}/[\{(K31)^{\frac{1}{2}}-1\}\cdot R83\cdot\beta 81] \quad (99)$$

By substituting the equation (94) into the equation (99), the following equation (100) can be obtained as $$1/\{R83\cdot(VGS81-VGS82)\}=I81=\beta 81\cdot(VGS81-VTH)^2=\{(1/(R83)^2\cdot(\beta 81)\}\cdot[K31/\{(K31)^{\frac{1}{2}}-1\}^2] \quad (100)$$

By substituting the equations (99) and (100) into the equation (95), the following equation (101) can be obtained as $$V1=\{1/(\beta 81)\cdot(R83)\}\cdot[(K31)^{\frac{1}{2}}/\{(K31)^{\frac{1}{2}}-1\}]\times[1+(R81/R83)\cdot\{(K31)^{\frac{1}{2}}/\{(K31)^{\frac{1}{2}}-1\}]+VTH \quad (101)$$

From the equation (101), it can be found that the voltage V1 can be expressed by the sum of the voltage term inversely proportional to transconductance parameter $\beta 81$ and the term of the threshold voltage VTH.

Transconductance parameter $\beta 81$ can be expressed in terms of the electron mobility $\mu n$, the gate oxide film capacity per unit area COX, the gate width W and the gate length L as $$\beta 81=\mu n\cdot(COX/2)(W/L) \quad (102)$$

The temperature characteristic of the transconductance parameter $\beta 81$ depends on the temperature characteristic of the mobility $\mu n$, however, the temperature characteristic of the mobility $\mu n$ can be expressed as the primary approximation as $$1/\mu n(T)=(1/\mu n(T0))\cdot(T/T0)^{3/2} \quad (103)$$

Hence, ($1/\beta 81$) can be expressed as follows:

$$1/\beta 81=(1/\beta 810)\cdot(T/T0)^{3/2} \quad (104)$$

where $\beta 810$ is $\beta 81$ at absolute temperature T0, meaning $\beta 81$(T0).

By substituting the equation (104) into the equation (101), the voltage V1 can be obtained as follows:

$$V1=\{1/(\beta 810)\cdot(R83)\}\cdot(T/T0)^{3/2}\cdot[K31/\{(K31)^{\frac{1}{2}}-1\}\times[1+(R81/R83)\cdot[(K31)^{\frac{1}{2}}/\{(K31)^{\frac{1}{2}}-1\}]+VTH \quad (105)$$

The temperature characteristic of the voltage V1 obtained by differentiating the equation (105) with respect to absolute temperature T can be expressed as follows:

$$dV1/dT) = (3/2)\cdot[1/\{(\beta 810)\cdot(R83)\}]\cdot\{T^{\frac{1}{2}}/(T0)^{3/2}\}\times[(K31)^{\frac{1}{2}}/\{(K31)^{\frac{1}{2}}-1\}]\times[1+(R81/R83)\cdot[(K31)^{\frac{1}{2}}/\{(K31)^{\frac{1}{2}}-1\}]]- \quad (106)$$

-continued $$\{1/(\beta 810)\cdot(R83)^2\}\cdot(T/T_0)^{3/2}\cdot[(K31)^{\frac{1}{2}}/\{(K31)^{\frac{1}{2}}-1\}]\times[[1+(R81/R83)\cdot[(K31)^{\frac{1}{2}}/\{(K31)^{\frac{1}{2}}-1\}]]\cdot(dR83/dT)+(dVTH/dt)$$

As a result, the temperature characteristic at T=T0 and T=300K can be respectively expressed as follows:

$$(dV1/dT)|(T=T0)= \tag{107}$$
$$(3/2)\cdot\{1/(\beta 810)\cdot(R83)\cdot T_0\}\cdot[(K31)^{\frac{1}{2}}/\{(K31)^{\frac{1}{2}}-1\}]\times[1+(R81/R83)\cdot[(K31)^{\frac{1}{2}}/\{(K31)^{\frac{1}{2}}-1\}]]-\{1/(\beta 810)\cdot(R83)^2\}\cdot[(K31)^{\frac{1}{2}}/\{(K31)^{\frac{1}{2}}-1\}]\times[1+(R81/R83)\cdot[(K31)^{\frac{1}{2}}/\{(K31)^{\frac{1}{2}}-1\}]]\times(dR83/dT)|(T=T0)+(dVTH/dT)|(T=T0)$$

$$(dV1/dT)|(T=300K)= \tag{108}$$
$$\{0.005-(1/R83)\cdot(dR83/dT)|(T=300K)\}\cdot\{1/(\beta 810)\cdot(R83)\}\times[(K31)^{\frac{1}{2}}/\{(K31)^{\frac{1}{2}}-1\}]\times[1+(R81/R83)\cdot[(K31)^{\frac{1}{2}}/\{(K31)^{\frac{1}{2}}-1\}]]+(dVTH/dT)|(T=300\ K)$$

Here, the threshold voltage VTH is about −2.7 mV/deg according to the already mentioned reference literature "MOS Integrated Circuits" and as a result, the following equation can be obtained as $$(dVTH/dT)=-2.7\ mV/deg \tag{109}$$

Here, suppose that the temperature characteristic of the resistor R83 is obtained as $$(1/R83)\cdot(dR83/dT)|(T=300K)=0.0006/deg \tag{110}$$

If the following equation (111) is established as $$\{1/(\beta 810)\cdot(R83)\}\cdot[(K31)^{\frac{1}{2}}/\{(K31)^{\frac{1}{2}}-1\}]\times[1+(R81/R83)\cdot[(K31)^{\frac{1}{2}}/\{(K31)^{\frac{1}{2}}-1\}]]=0.614\ V \tag{111}$$

then, (dV1/dT) at T=300K becomes zero,

This means that if VTH=0.7 V at T=300K, V1=1.314 V results, thus the temperature characteristic of the voltage V1 becoming zero.

In general, the temperature characteristic of the voltage V1, or (dV1/dT) is, as seen from the equation (105), positive when the value of the left side of the equation (111) is larger than 0.614 V (see the following equation (112) and negative when it is smaller than 0.614 V (see the following equation (113)).

$$(dV1/dT)|(T=300K)>0 \tag{112}$$

$$(dV1/dT)|(T=300K)<0 \tag{113}$$

Practically, the temperature characteristic of the resistor R83 does not necessarily becomes the value specified by the equation (110) depending on the difference in production process, having the variation of about ± several thousands ppm/deg. In this case, however, the following equation (114) is established with respect to the terms included in the equation (106), and the temperature characteristic of the threshold voltage VTH is smaller than zero, or (dVTH/dT)<0, so that the temperature characteristic of the voltage V1 shown by the equation (106), or (dV1/dT) can be set so as to be positive, negative or zero arbitrarily.

$$(3/2)\{T^{\frac{1}{2}}/(T0)^{3/2}\}-(1/R83)\cdot(dR83/dT)>0 \tag{114}$$

In addition, V1=V2, so that the voltages V1 and V2 each can be used for the reference voltage.

As explained above, in the reference voltage generator of this invention, the characteristic of the drain current I82 of the transistor M82 and the characteristic of the voltage V2 are prevented from effecting contrariwise each other, and the voltages V1 and V2 are surely made equal to each other.

As a result, the voltage V1 or voltage V2 for providing the reference voltage as an output voltage of the reference voltage generator is formed of the sum of a voltage inversely proportional to transconductance parameter β81 and the threshold voltage VTH, so that the temperature characteristic of the voltages V1 and V2 each can be arbitrarily set so as to be positive, negative or zero.

Consequently, the reference voltage generator of this embodiment can be appropriately realized on a CMOS integrated circuit.

[Fifteenth Embodiment]

Figure 17:
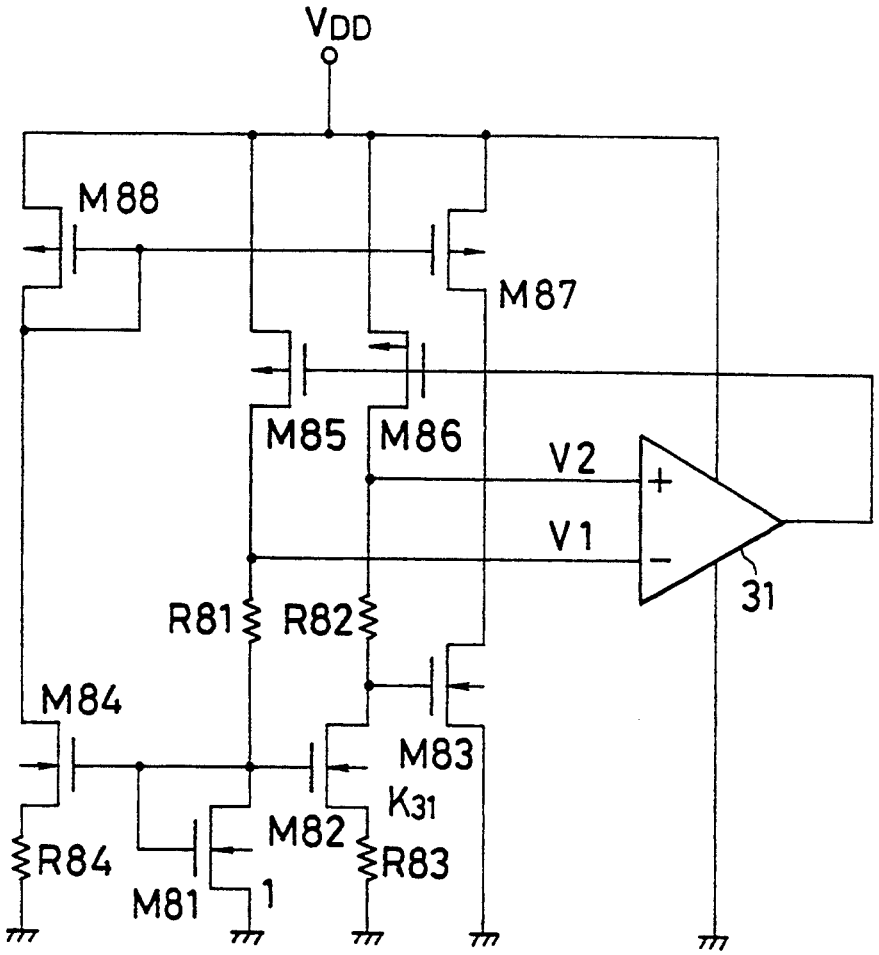
FIG. 17 is a circuit diagram of a reference voltage generating circuit according to a fifteenth embodiment of this invention.

FIG. 17 shows a reference voltage generator according to a fifteenth embodiment of this invention, which is a modification example of the fourteenth embodiment.

A reference voltage generator of FIG. 17 is similar in structure to the reference voltage generator of the fourteenth embodiment excepting that the resistor R83 provided between the gate and drain of the transistor M81 in the fourteenth one is removed thereby to connect them directly, and the resistor R83 is provided between the source of the transistor M82 and the earth instead, and a resistor R84 is provided between the source of the transistor M84 and the earth.

Such circuit has the same effects as those of the fourteenth embodiment.

[Sixteenth Embodiment]

Figure 18:
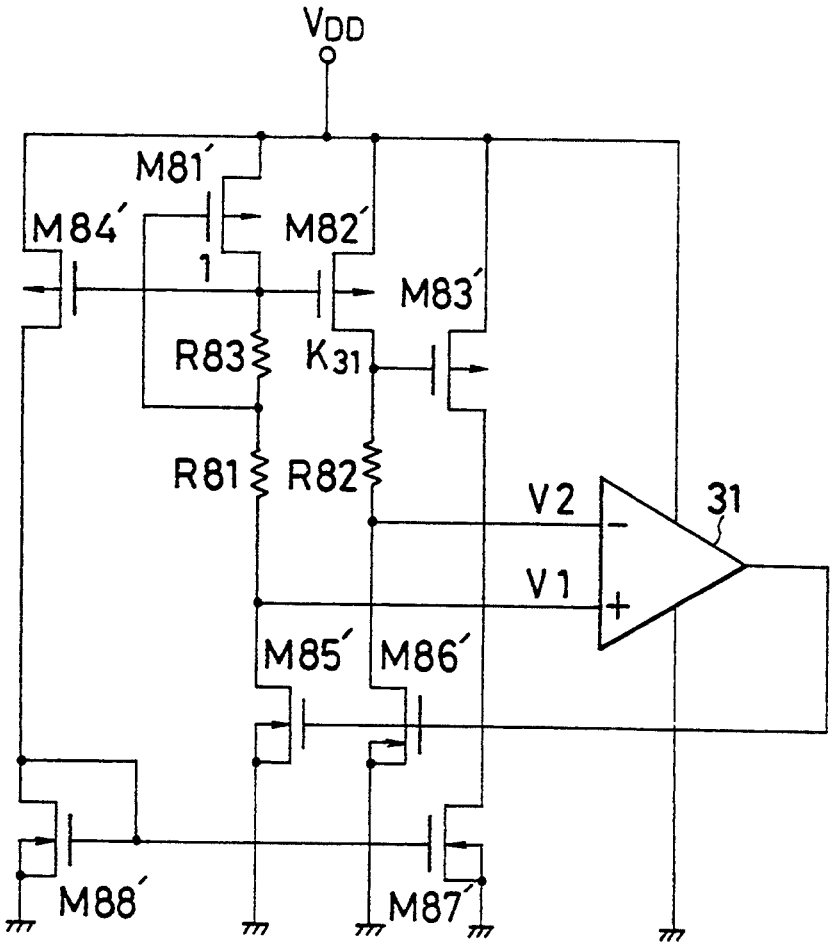
FIG. 18 is a circuit diagram of a reference voltage generating circuit according to a sixteenth embodiment of this invention.

FIG. 18 shows a reference voltage generator according to a sixteenth embodiment of this invention, which is also a modification example of the fourteenth embodiment.

In a reference voltage generator shown in FIG. 18, eight MOS transistors M81' to M88' each is opposite in polarity to the corresponding one of the eight MOS transistors M81 to M88 of the fourteenth embodiment. Namely, the reference voltage generator of this embodiment is similar in structure to that of the fourteenth embodiment excepting that four N-channel MOS transistors M85', M86', M87' and M88' are provided on the earth side and four P-channel MOS transistors M81', M82', M83' and M84' are provided on the side of a direct current power source, and their sources, gates and drains and the resistors R81, R82 and R83 are connected opposite to the case of the fourteenth embodiment between the earth side and direct current power source side.

Such circuit has the same effects as those of the fourteenth embodiment.

In the above embodiments, each of the circuits comprises transistors, however, it may comprises FETs other than MOS transistors.

What is claimed is:

1. A constant voltage circuit comprising:

(a) a reference voltage generator and an error amplifier for correcting a temperature characteristic of a reference voltage outputted from said reference voltage generator;

(b) said reference voltage generator including;

a constant current source;

a first field effect transistor which has a gate connected through a first resister to said constant current source and a drain connected to said gate of said first transistor;

a second field effect transistor which as a gate connected to said drain of said first transistor and a drain connected through a second resistor to said constant current source; and a third field effect transistor which has a gate connected to said drain of said second transistor and a drain connected to said constant current source;

said first, second and third transistors being driven by said constant current source;

(c) said error amplifier including;

a differential circuit having a differential pair of fourth and fifth field effect transistors whose relative capacity ratio is K1 where $K1>0$;

a first input end of said differential pair being supplied said reference voltage generated at a connecting point of said constant current source and said first and second resistors;

an active load for said differential circuit;

said active load having sixth and seventh field effect transistors whose relative capacity ratio is K2 where; $K2>0$; and an output circuit receiving an output of said differential circuit through said active load and outputting a constant output voltage;

said output circuit having third and fourth resistors for producing a feedback voltage by dividing said constant output voltage;

a second input end of said differential pair being supplied said feedback voltage from said output circuit.

2. The constant voltage circuit as claimed in claim 1, wherein said drain and gate of said first transistor are connected directly to each other.

3. The constant voltage circuit as claimed in claim 1, wherein said drain and gate of said first transistor is connected through a fifth resistor to each other.

4. The constant voltage circuit as claimed in claim 1 wherein said source of said second transistor is not connected to a resistor and is connected directly to earth.

5. The constant voltage circuit as claimed in claim 1 wherein said source of said second transistor has a sixth resistor and is connected through said sixth resistor to earth.

6. The constant voltage circuit as claimed in claim 1 wherein said output circuit of said error amplifier comprises an eighth field effect transistor into which said output from said differential circuit is inputted through said active load, and said third and fourth resistors for dividing said constant output voltage are connected to said source of said eighth transistor.

7. The constant voltage circuit as claimed in claim 1 wherein said output circuit comprises an eighth field effect transistor for level shifting into which said output from said differential circuit is inputted through said active load, and a ninth field effect transistor into which an output from said eighth transistor is inputted, said third and fourth resistors for dividing said constant output voltage being connected to said source of said ninth transistor.

8. A constant voltage circuit comprising:

(a) a constant current circuit, a reference voltage generator driven by an output current from said constant current circuit and generating a reference voltage, and an offset generator correcting a temperature characteristic of said reference voltage to output a constant voltage;

(b) said reference voltage generator including a first field effect transistor which has a gate connected through a first resister to an output end of said constant current circuit and a drain connected to said gate of said first transistor;

a second field effect transistor which has a gate connected to said drain of said first transistor and a drain connected through a second resistor to said output end of said constant current circuit;

a third field effect transistor which has a gate connected to said drain of said second transistor and a drain connected to said output end of said constant current circuit;

(c) said constant current circuit including a fourth field effect transistor which has a gate and a drain connected each other through a third resistor;

a fifth field effect transistor which has a gate connected to said drain of said fourth transistor;

a current mirror circuit for driving said fourth and fifth transistors and for supplying a driving constant current to said reference voltage generator;

(d) said offset generator including a differential circuit having a differential pair of sixth and seventh field effect transistors whose capacity ratios are different from each other;

an active load for said differential circuit having a differential pair of eighth and ninth field effect transistors whose capacity ratios are different from each other;

an output circuit receiving through said active load an output of said differential circuit and outputting a constant output voltage;

a first input end of said differential pair being supplied said reference voltage outputted from said reference voltage generator and a second input end of said differential pair being supplied said output voltage from said offset generator.

9. The constant voltage circuit as claimed in claim 8, wherein said drain and gate of said first transistor are connected directly to each other.

10. The constant voltage circuit as claimed in claim 8, wherein said drain and gate of said first transistor are connected through a fourth resistor to each other.

11. The constant voltage circuit as claimed in claim 8, wherein said source of said second transistor does not have a resistor and is connected directly to earth.

12. The constant voltage circuit as claimed in claim 8, wherein said source of said second transistor has a fifth resistor and is connected through said fifth resistor to earth.

13. The constant voltage circuit as claimed in claim 8, wherein said source of said fifth transistor does not have a resistor and is connected directly to earth.

14. The constant voltage circuit as claimed in claim 8, wherein said source of said fifth transistor has a sixth resistor and is connected through said sixth resistor to earth.

15. A reference voltage generating circuit comprising:

(a) a constant current circuit;

(b) a constant voltage generator driven by said constant current circuit;

(c) a reference voltage being outputted at a connection end between said constant current circuit and said constant voltage generator;

(d) said constant voltage generator including a first field effect transistor which has a gate connected through a first resistor to an output end of said constant current circuit and a drain connected to said gate of said first transistor;

a second field effect transistor which has a gate connected to said drain of said first transistor and a drain connected through a second resistor to said output end of said constant current circuit;

a third field effect transistor which has a gate connected to said drain of said second transistor and a drain connected to said output end of said constant current circuit;

said first and second transistors forming a first peaking current mirror circuit;

(e) said constant current circuit including a fourth field effect transistor which has a gate and a drain connected to each other;

a fifth field effect transistor which has a gate connected to said drain of said fourth transistor;

said fourth and fifth transistors forming a second peaking current mirror circuit;

a first constant current source which drives said fourth and fifth transistors;

a second constant current source which supplies a driving current to said constant voltage generator;

(f) said peaking characteristics of said first and second peaking current mirror circuits being arranged so that a temperature characteristic of said reference voltage is cancelled.

16. The constant voltage circuit as claimed in claim 15, wherein said gate and drain of said first transistor are connected directly to each other.

17. The constant voltage circuit as claimed in claim 15, wherein said gate and drain of said first transistor are connected through a third resistor to each other.

18. The constant voltage circuit as claimed in claim 15, wherein said gate of said second transistor is connected directly to said drain of said first transistor.

19. The constant voltage circuit as claimed in claim 15, wherein said gate of said second transistor is connected through a fourth resistor to said drain of said first transistor.

20. The constant voltage circuit as claimed in claim 15, wherein said gate and drain of said fourth transistor are connected directly to each other.

21. The constant voltage circuit as claimed in claim 15, wherein said gate and drain of said fourth transistor are connected through a fifth resistor to each other.

22. The constant voltage circuit as claimed in claim 15, wherein a source of said fifth transistor has no resistor and is connected directly to earth.

23. The constant voltage circuit as claimed in claim 15, wherein a source of said fifth transistor has a sixth resistor and is connected through said fifth resistor to earth.

24. A reference voltage generating circuit comprising:

(a) a first current source;

(b) a second current source;

(c) a first field effect transistor which as a source connected to the earth side, a gate connected through a first resistor to said first current source and a drain connected to said gate of said first transistor;

(d) a second field effect transistor which has a source connected to the earth side, a gate connected to said drain of said first transistor and a drain connected through a second resistor to said second current source;

(e) a first control circuit which controls said first and second current sources so that a first voltage generated at a connecting end to said first current source and said first resistor and a second voltage generated at a connecting end to said current source and said second resistor are equal to each other; and (f) a second control circuit which controls said second transistor so that a characteristic of a drain current of said second transistor and a characteristic of said second voltage do not adversely effect each other.

25. The constant voltage circuit as claimed in claim 24, wherein said drain and gate of said first transistor are connected directly to each other.

26. The constant voltage circuit as claimed in claim 24, wherein said drain and gate of said first transistor are connected through a third resistor to each other.

27. The constant voltage circuit as claimed in claim 24, wherein said source of said second transistor as no resistor and is connected directly to the earth side.

28. The constant voltage circuit as claimed in claim 24, wherein said source of said transistor has a fourth resistor and is connected through said fourth resistor to the earth side.

29. A reference voltage generating circuit comprising:

(a) a first current source;

(b) a second current source;

(c) a first field effect transistor which has a source connected to the power source side, a gate connected through a first resistor to said first current source and a drain connected to said gate of said first transistor;

(d) a second field effect transistor which has a source connected to the power source side, a gate connected to said drain of said first transistor and a drain connected through a second resistor to said second current source;

(e) a first control circuit which controls said first and second current sources so that a first voltage generated at a connecting end to said first current source and said first resistor and a second voltage generated at a connecting end to said second current source and said second resistor are equal to each other; and (f) a second control circuit which controls said second transistor so that a characteristic of a drain current of said second transistor and a characteristic of said second voltage do not adversely effect each other.

30. The constant voltage circuit as claimed in claim 29, wherein said drain and gate of said first transistor are connected directly to each other.

31. The constant voltage circuit as claimed in claim 29, wherein said drain and gate of said first transistor are connected through a third resistor to each other.

32. The constant voltage circuit as claimed in claim 29, wherein said source of said second transistor has no resistor and is connected directly to the power source side.

33. The constant voltage circuit as claimed in claim 29, wherein said source of said second transistor has a fourth resistor and is connected through said fourth resistor to the power source side.

34. A constant voltage circuit comprising:

(a) a reference voltage generator for outputting a reference voltage;

(b) an error amplifier for correcting a temperature characteristic of said reference voltage outputted from said reference voltage generator;

(c) said reference voltage generator including:

first, second and third field effect transistors and a constant current source for driving said first, second and third field effect transistors;

said first field effect transistor having a gate connected through a first resister to said constant current source and a drain connected to said gate of said first transistor;

said second field effect transistor having a gate connected to said drain of said first field effect transistor and a drain connected through a second resistor to said constant current source; and said third field effect transistor having a gate connected to said drain of said second field effect transistor and a drain connected to said constant current source; and (d) said error amplifier including:

a differential circuit having a differential pair of fourth and fifth field effect transistors whose relative capacity ratio is K1 where K1>0;

a first input end of said differential pair being supplied said reference voltage generated at a connection point of said constant current source and said first and second resistors;

an active load for said differential circuit having sixth and seventh field effect transistors whose relative capacity ratio is K2 where K2>0;

an output circuit receiving through said active load an output of said differential circuit and outputting a constant output voltage; and said output circuit producing a feedback voltage from said constant output voltage; and a second input end of said differential pair being supplied said feedback voltage.

35. A constant voltage circuit comprising:

(A) a reference voltage generator for outputting a reference voltage;

said reference voltage generator having first, second and third field effect transistors;

said reference voltage having a temperature characteristic proportional to a difference between gate-source voltages of said first and second transistors; and (B) an error amplifier for correcting said temperature characteristic of said reference voltage outputted from said reference voltage generator;

said error amplifier including:

(a) a differential circuit having a differential pair of fourth and fifth field effect transistors whose relative capacity ratio is K1 where K1>0 and a constant current source for driving said third and fourth transistors;

sources of said fourth and fifth transistors being coupled together and connected to said constant current source;

a gate of said fourth transistor being supplied said reference voltage;

(b) an active load for said differential circuit;

said active load having sixth and seventh field effect transistors whose relative capacity ratio is K2 where K2>0;

(c) an offset voltage being produced by a difference between gate-source voltages of said third and fourth transistors;

said offset voltage changing dependent on values of K1 and K2 to be plus(+), zero(0) or minus(−) in value;

(d) an output circuit receiving through said active load an output of said differential circuit and outputting a constant output voltage;

said output circuit producing a feedback voltage from said constant output voltage; and (e) a gate of said fifth transistor being supplied said feedback voltage.

36. A constant voltage circuit comprising:

(a) a constant current circuit providing an output current having a temperature characteristic;

(b) a reference voltage generator driven by said constant output current from said constant current circuit and generating a reference voltage;

(c) said reference voltage generator including a first field effect transistor which has a gate connected through a first resister to an output end of said constant current circuit and a drain connected to said gate of said first transistor;

a second field effect transistor which has a gate connected to said drain of said first transistor and a drain connected through a second resistor to said output end of said constant current circuit;

a third field effect transistor which has a gate connected to said drain of said second transistor and a drain connected to said output end of said constant current circuit;

(d) an offset generator for providing an offset voltage having a temperature characteristic and a constant output voltage;

said offset generator including a differential circuit having a differential pair of fourth and fifth field effect transistors whose capacity ratios are different from each other;

an active load for said differential circuit having a differential pair of sixth and seventh field effect transistors whose relative capacity ratios are different from each other;

a first input end of said differential pair being supplied said reference voltage from said reference voltage generator and a second input end of said differential pair being supplied said output voltage from said offset generator;

said offset voltage being produced by a difference between gate-source voltages of said fourth and fifth field effect transistors;

said constant output voltage being produced from an output of said differential circuit through said active load.

(e) a temperature characteristic of said reference voltage being compensated by changing said temperature characteristic of said offset voltage.

* * * * *